US011217933B2

(12) United States Patent
Aoki et al.

(10) Patent No.: US 11,217,933 B2
(45) Date of Patent: Jan. 4, 2022

(54) CONNECTOR WITH SEALING PART

(71) Applicant: Yazaki Corporation, Tokyo (JP)

(72) Inventors: Eiji Aoki, Shizuoka (JP); Kazuhide Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 17/031,025

(22) Filed: Sep. 24, 2020

(65) Prior Publication Data

US 2021/0091507 A1 Mar. 25, 2021

(30) Foreign Application Priority Data

Sep. 25, 2019 (JP) ..... JP2019-173649

(51) Int. Cl.
*H01R 11/12* (2006.01)
*H01R 13/52* (2006.01)

(52) U.S. Cl.
CPC ..... *H01R 13/5208* (2013.01); *H01R 11/12* (2013.01); *H01R 2201/26* (2013.01)

(58) Field of Classification Search
CPC .. H01R 13/5208; H01R 11/12; H01R 13/521; H01R 2201/26
See application file for complete search history.

(56) References Cited

U.S. PATENT DOCUMENTS 7,077,676 B2 * 7/2006 Matsumoto ..... H01R 13/5205 439/271
7,338,304 B2 * 3/2008 Kameyama ..... H01R 13/521 439/271
9,004,928 B2 * 4/2015 Tanaka ..... B60L 3/0069 439/86
2011/0316372 A1 * 12/2011 Kobayashi ..... H02K 5/225 310/71
2014/0322973 A1 * 10/2014 Okamoto ..... H01R 13/4223 439/587
2018/0358748 A1 * 12/2018 Yamanashi ..... H01R 24/62

FOREIGN PATENT DOCUMENTS

JP 2018-116896 A 7/2018

* cited by examiner

*Primary Examiner* — Tho D Ta
(74) *Attorney, Agent, or Firm* — Sughrue Mion, PLLC

(57) ABSTRACT

A connector includes: a housing having a first through-hole; a plate-shaped conductor inserted into the first through-hole; and a sealing part that has a flat annular shape in a plane view and seals between the conductor and the hosing. The sealing part has a pair of linear first sealing parts and a pair of arc-shaped second sealing parts. The housing has a recess that has a flat shape in a plan view and receives the sealing part. An inner dimension in a longitudinal direction of the recess is substantially equal to an outer dimension in the longitudinal direction of the sealing part, and an inner dimension in a short direction of the recess is smaller than an outer dimension in a short direction of the sealing part. The conductor presses and compresses the first sealing part and the second sealing part in a held state.

7 Claims, 24 Drawing Sheets

CONNECTOR WITH SEALING PART

CROSS-REFERENCE TO RELATED APPLICATION(S)

The present application claims priority to and incorporates by reference the entire contents of Japanese Patent Application No. 2019-173649 filed in Japan on Sep. 25, 2019.

BACKGROUND OF THE INVENTION

1. Field of the Invention

The present invention relates to a connector.

2. Description of the Related Art

In the related art, a connector having a sealing member is known. Japanese Patent Application Laid-open No. 2018-116896 discloses a technology of a connector including a main housing retaining a main terminal for relaying a main circuit, an electric wire with a connector including an electric wire for relaying a sub-circuit and a sub-connector connected to an end of the electric wire, and an electric wire retention part connecting with the main housing and retaining the electric wire.

In the connector of Japanese Patent Application Laid-open No. 2018-116896, a potting material or a rubber stopper seals between the electric wire and the electric wire retention part.

In a case where an annular sealing part is inserted into the housing in advance, when deformation such as bending occurs in the sealing part, an opening width may be narrowed. If the opening width of the sealing part is narrow, a conductor may interfere with the sealing part when the conductor is inserted into the sealing part. As a result of the interference, sealability may be deteriorated such as damage of the sealing part.

SUMMARY OF THE INVENTION

An object of the present invention is to provide a connector capable of suppressing the narrowing of an opening width of an annular sealing part.

In order to achieve the above mentioned object, a connector according to one aspect of the present invention includes an insulating housing configured to be fixed to a casing of a first device at a communication part through which an opening of the casing of the first device and an opening of a casing of a second device communicate with each other, and includes a first through-hole that allows an internal space of the first device and an internal space of the second device to communicate with each other; a plate-shaped conductor configured to be inserted into the first through-hole to electrically connect the first device and the second device; and a sealing part that has a flat annular shape in a plan view and seals between the conductor and the hosing, wherein the sealing part includes a pair of linear first sealing parts extending in a longitudinal direction and a pair of arc-shaped second sealing parts connecting end portions of the pair of first sealing parts, the housing includes a recess that has a flat shape in a plan view, is connected an end portion of the first through-hole, and receives the sealing part, an inner dimension in a longitudinal direction of the recess is substantially equal to an outer dimension in the longitudinal direction of the sealing part in a state in which the sealing part is not received in the recess, and an inner dimension in a short direction of the recess is smaller than an outer dimension in a short direction of the sealing part in the state in which the sealing part is not received in the recess, and the conductor presses the first sealing part and the second sealing part toward inner wall surfaces of the recess and compresses the first sealing part and the second sealing part in a held state in which the conductor has been inserted into the first through-hole and held by the housing.

According to another aspect of the present invention, in the connector, it is preferable that sizes of gaps between the conductor in the held state and the inner wall surfaces of the recess are sizes that allow a compression ratio of the first sealing part and a compression ratio of the second sealing part to be substantially equal to each other.

According to still another aspect of the present invention, in the connector, it is preferable that the inner wall surface of the recess has a first wall surface facing the first sealing part in the short direction of the recess and a second wall surface facing the second sealing part in the longitudinal direction of the recess, and when a thickness of the first sealing part in a plan view is D1 and a thickness of the second sealing part is D2 in a plan view in the state in which the sealing part is not received in the recess, a size of a gap between the conductor in the held state and the first wall surface is Gp1, and a size of a gap between the conductor and the second wall surface is Gp2, an Equation (1) below is satisfied, $$Gp1/D1=Gp2/D2 \quad (1).$$

According to still another aspect of the present invention, in the connector, it is preferable that when the sealing part is viewed in a plan view, a thickness of the second sealing part is smaller than a thickness of the first sealing part.

According to still another aspect of the present invention, in the connector, it is preferable that the conductor includes a body located at an intermediate part in a longitudinal direction of the conductor, a first terminal part located on one end side of the conductor with respect to the body and is connected to the first device, a second terminal part located on the other end side of the conductor with respect to the body and is connected to the second device, and a taper part provided between the body and the first terminal part, the body is a part that compresses the first sealing part and the second sealing part in the held state, and a width of the first terminal part is narrower than a width of the body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to embodiments of the present invention will be described in detail with reference to the drawings. Note that the invention is not limited to the embodiments. Furthermore, the components in the following embodiments include those that can be easily arrived at by a person skilled in the art or those that are substantially the same.

First Embodiment

Figure 1:
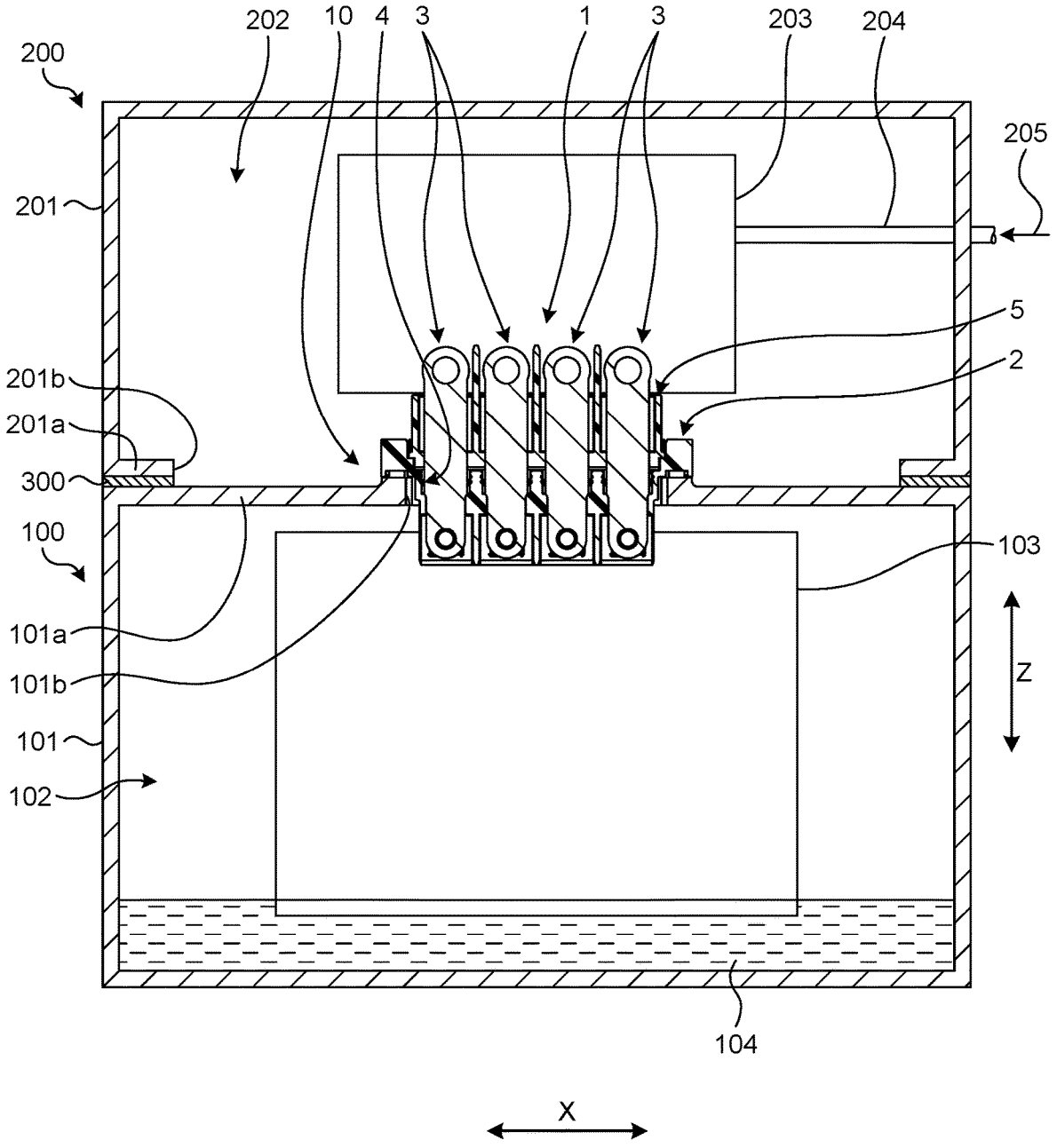
FIG. 1 is a sectional view of a connector, a first device, and a second device according to a first embodiment.
Figure 3:
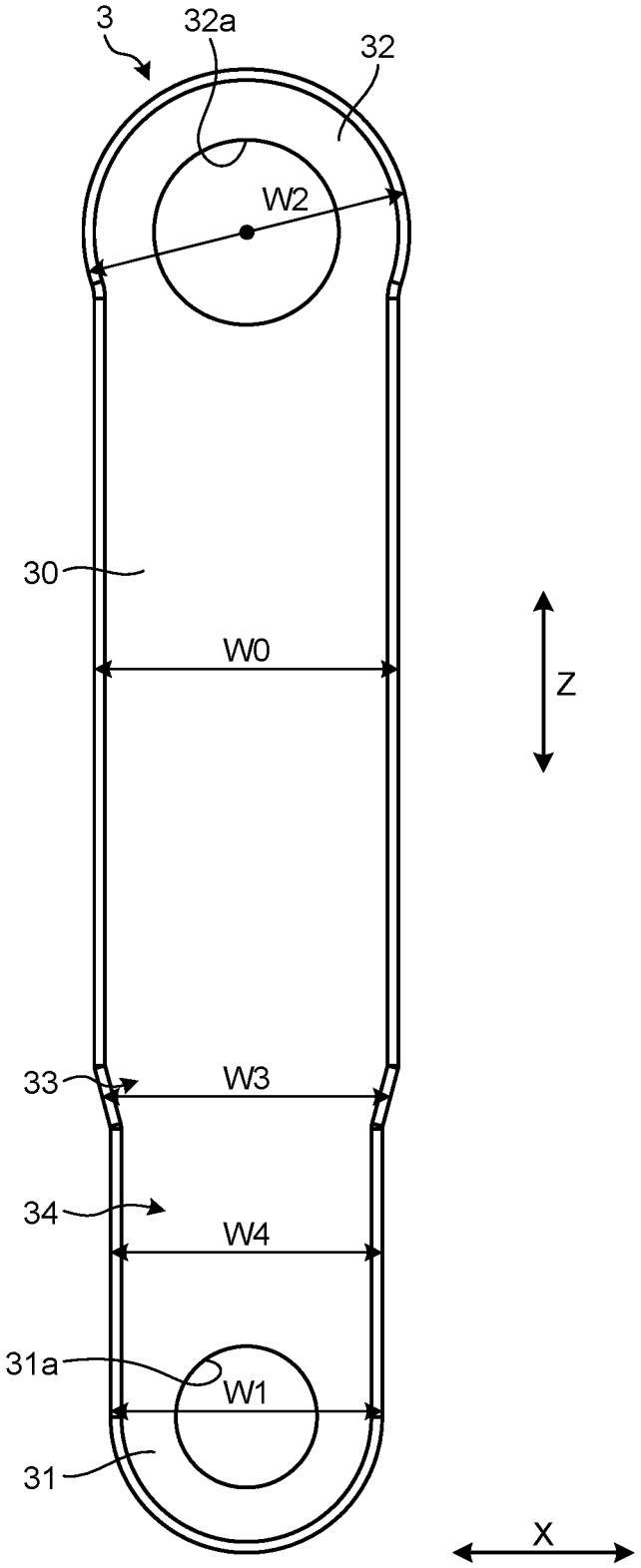
FIG. 3 is a front view of a conductor according to the first embodiment.
Figure 4:
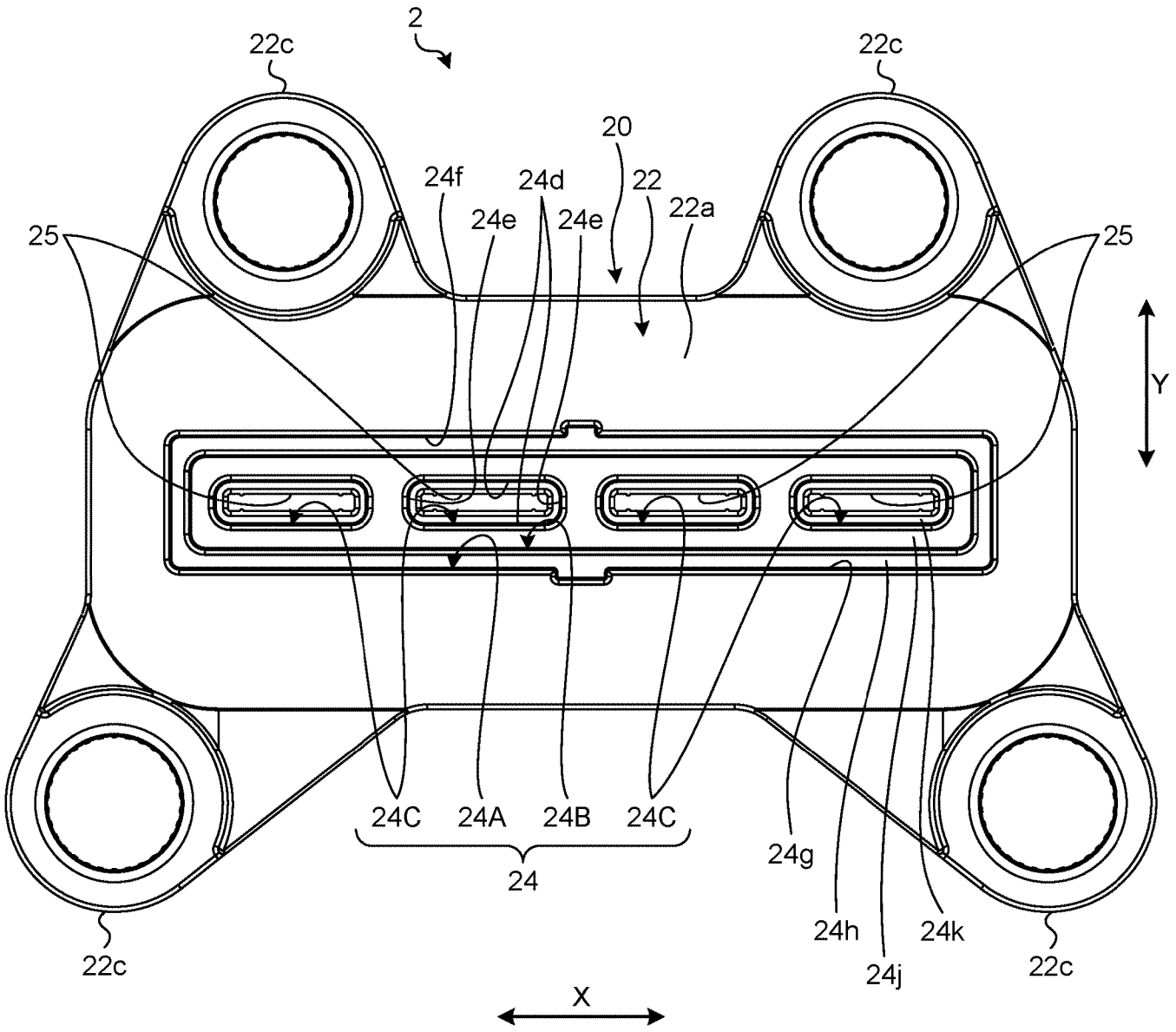
FIG. 4 is a plan view of a housing according to the first embodiment.
Figure 8:
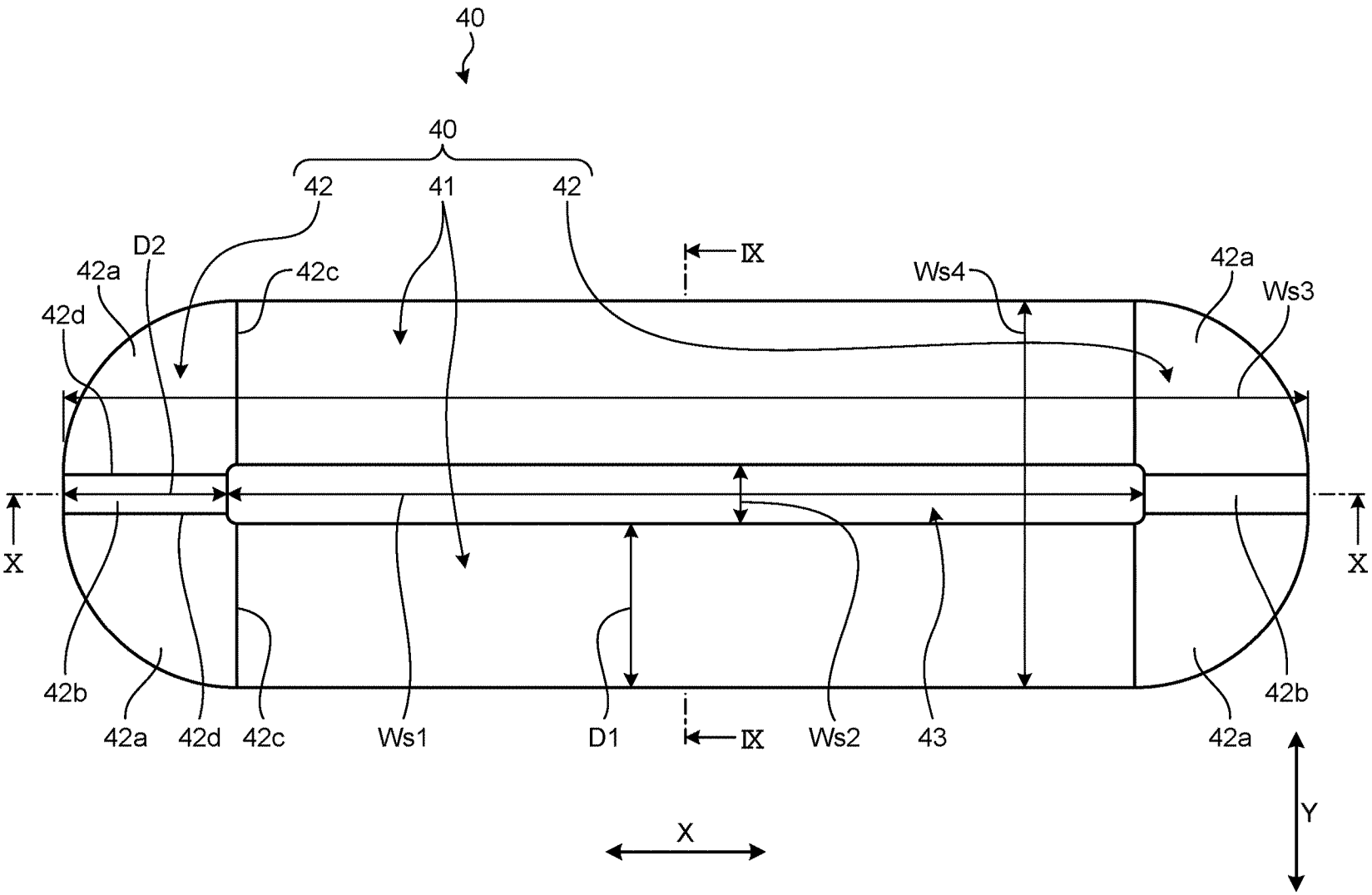
FIG. 8 is a plan view of a sealing member according to the first embodiment.
Figure 9:
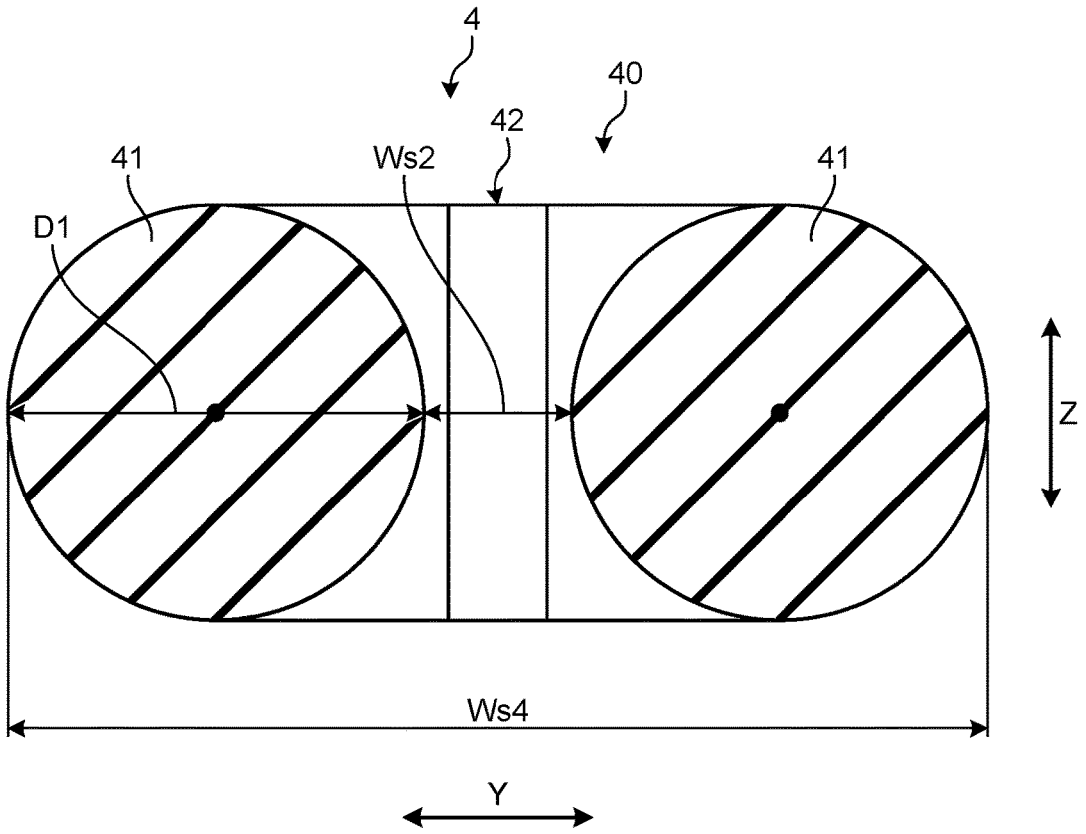
FIG. 9 is a sectional view of the sealing member according to the first embodiment.
Figure 10:
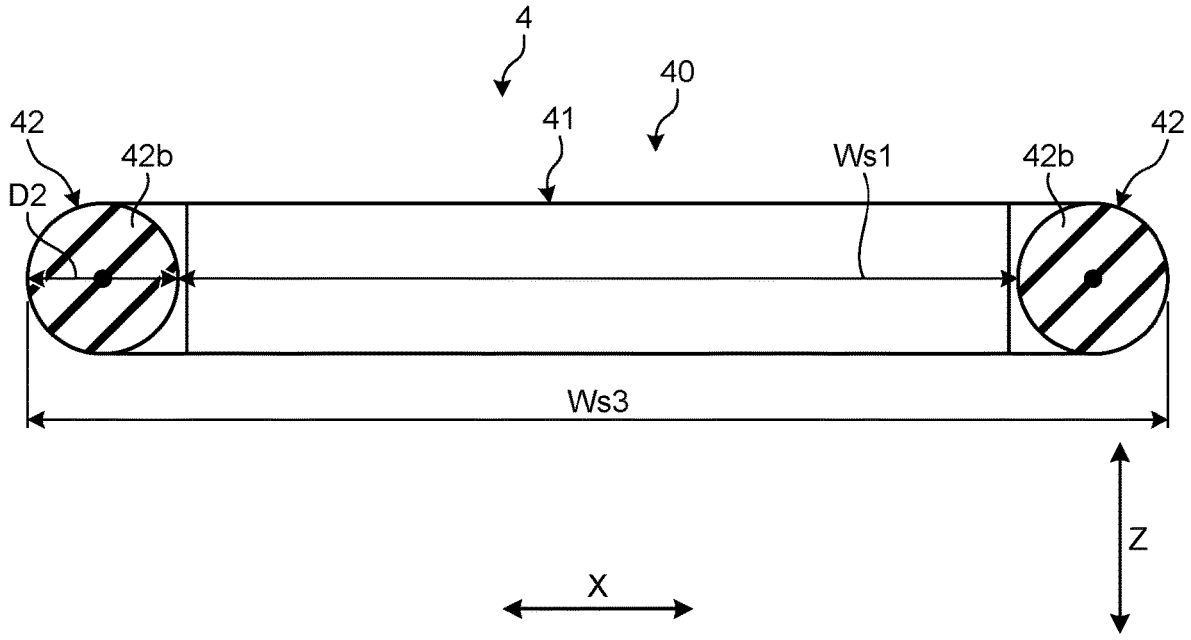
FIG. 10 is a sectional view of the sealing member according to the first embodiment.
Figure 11:
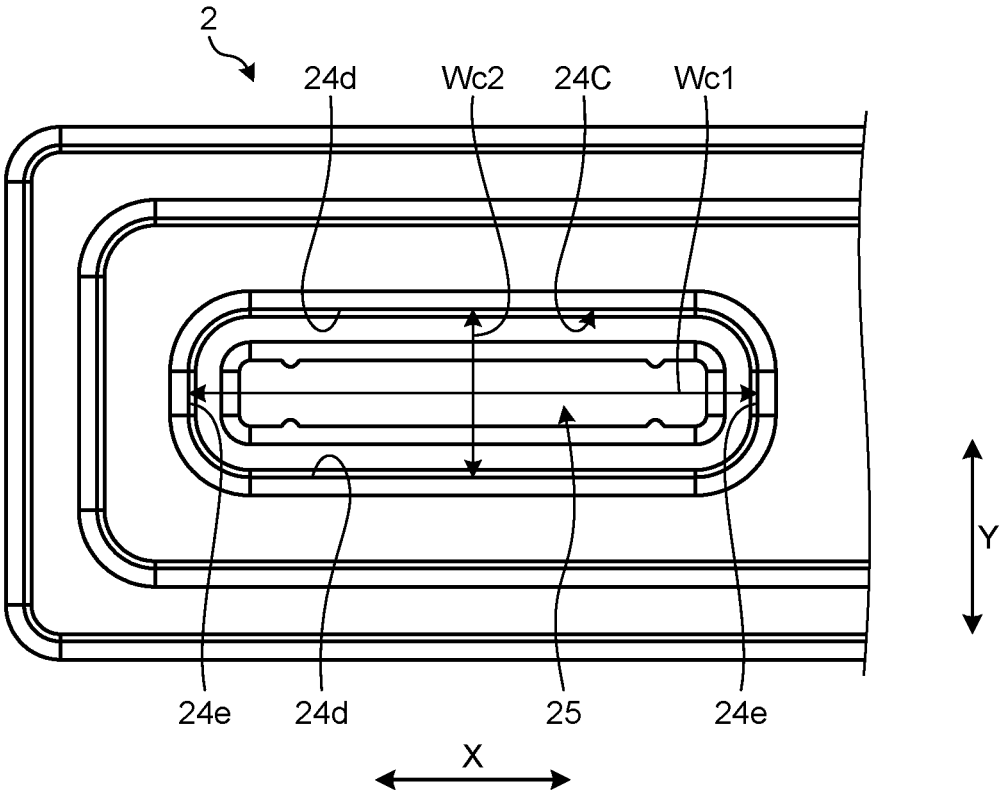
FIG. 11 is an enlarged view of a third recess according to the first embodiment.
Figure 12:
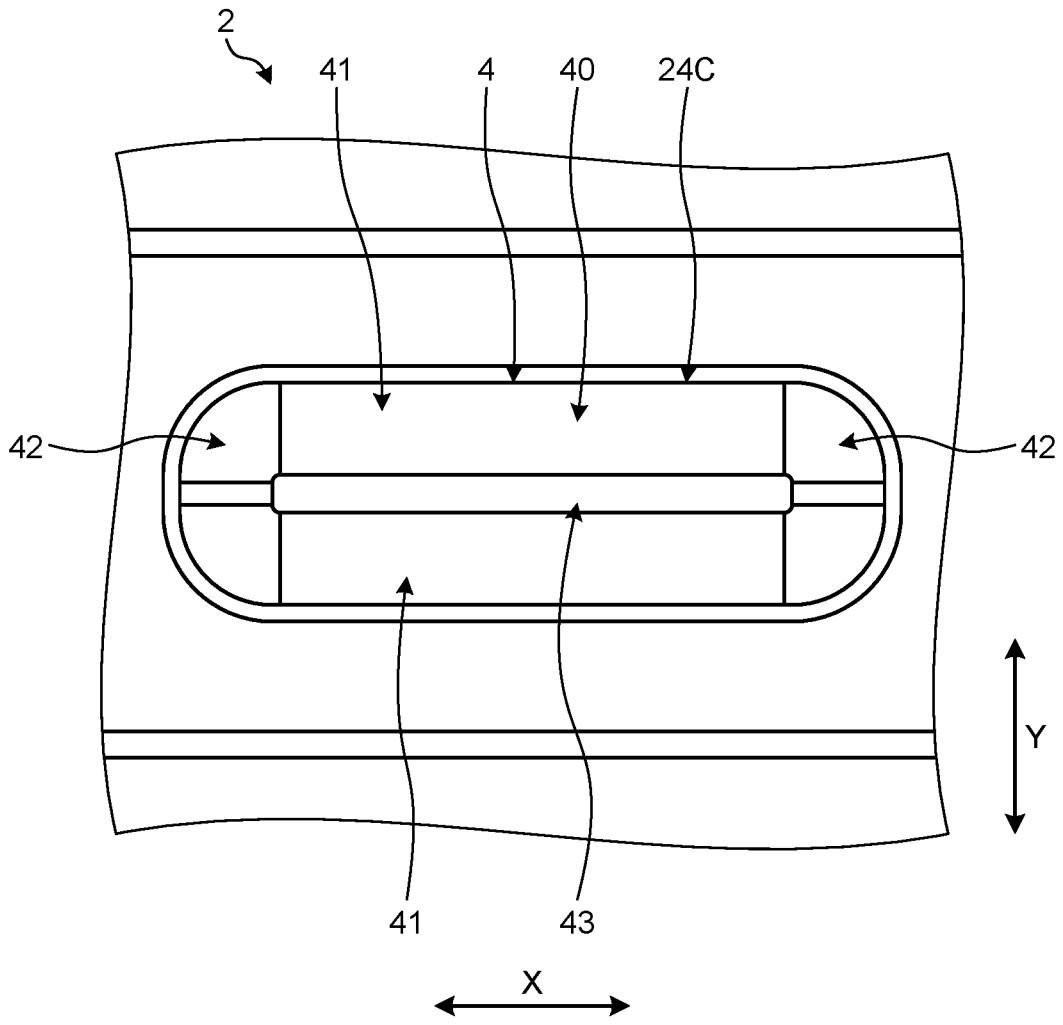
FIG. 12 is a plan view of the sealing member of the first embodiment received in the third recess.

With reference to FIG. 1 to FIG. 21, the first embodiment will be described. The present embodiment relates to a connector. FIG. 1 is a sectional view of a connector, a first device, and a second device according to the first embodiment, FIG. 2 is an exploded perspective view of the connector according to the first embodiment, FIG. 3 is a front view of a conductor according to the first embodiment, FIG. 4 is a plan view of a housing according to the first embodiment, FIG. 5 is a front view of the housing according to the first embodiment, FIG. 6 is a side view of the housing according to the first embodiment, FIG. 7 is a sectional view of the housing according to the first embodiment, FIG. 8 is a plan view of a sealing member according to the first embodiment, FIG. 9 is a sectional view of the sealing member according to the first embodiment, FIG. 10 is a sectional view of the sealing member according to the first embodiment, FIG. 11 is an enlarged view of a third recess according to the first embodiment, and FIG. 12 is a plan view of the sealing member of the first embodiment received in the third recess.

Figure 5:
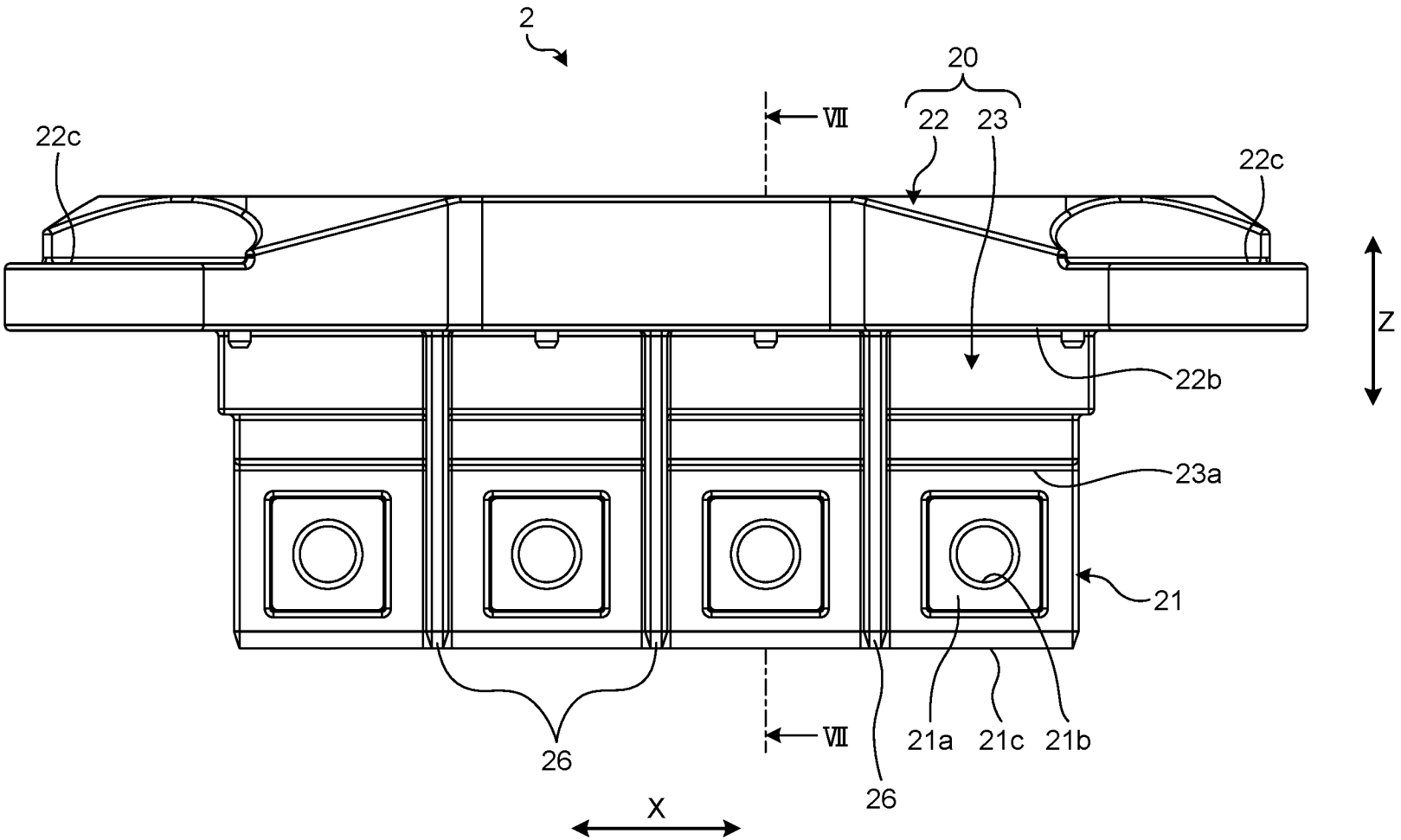
FIG. 5 is a front view of the housing according to the first embodiment.
Figure 6:
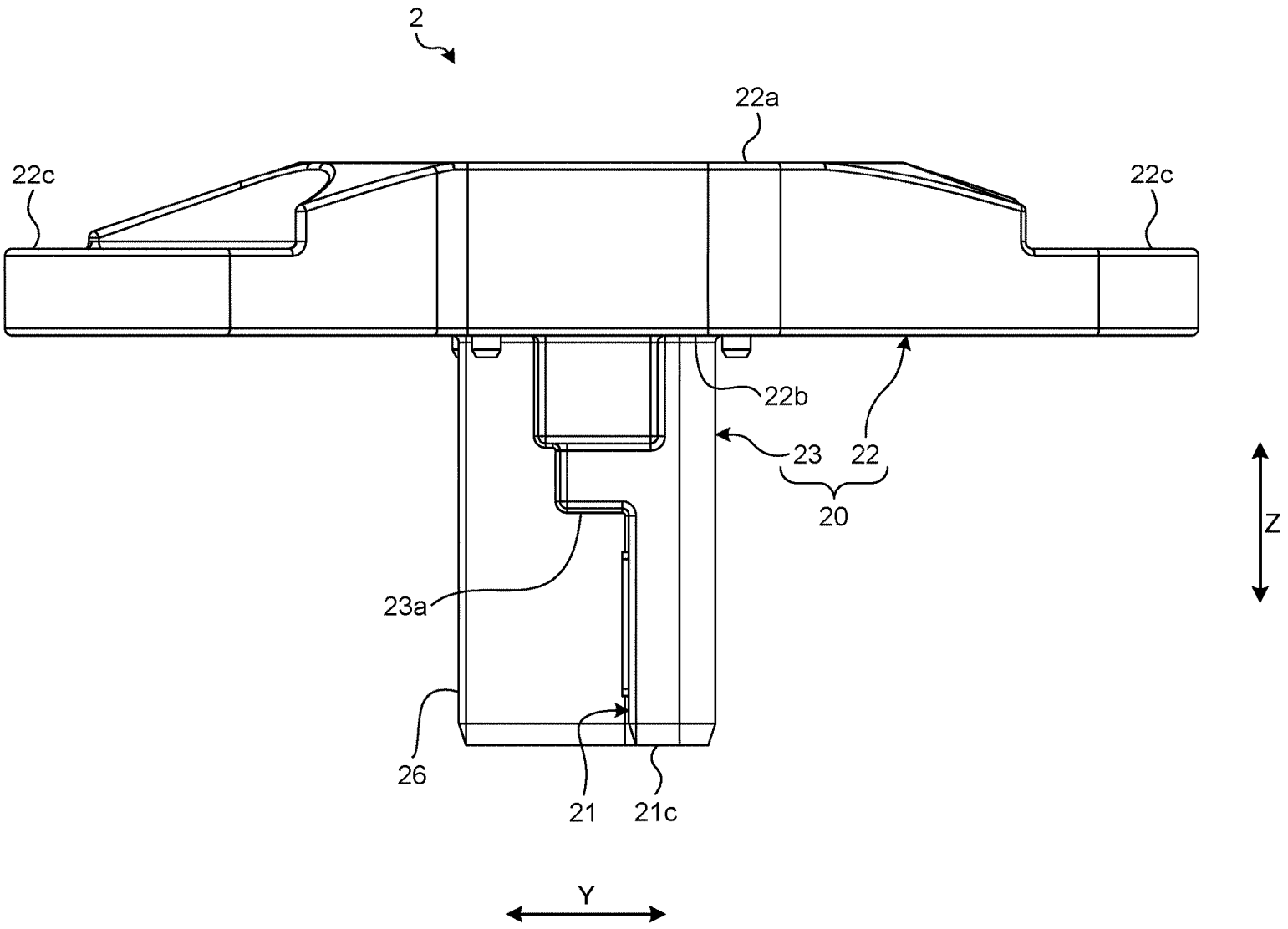
FIG. 6 is a side view of the housing according to the first embodiment.
Figure 7:
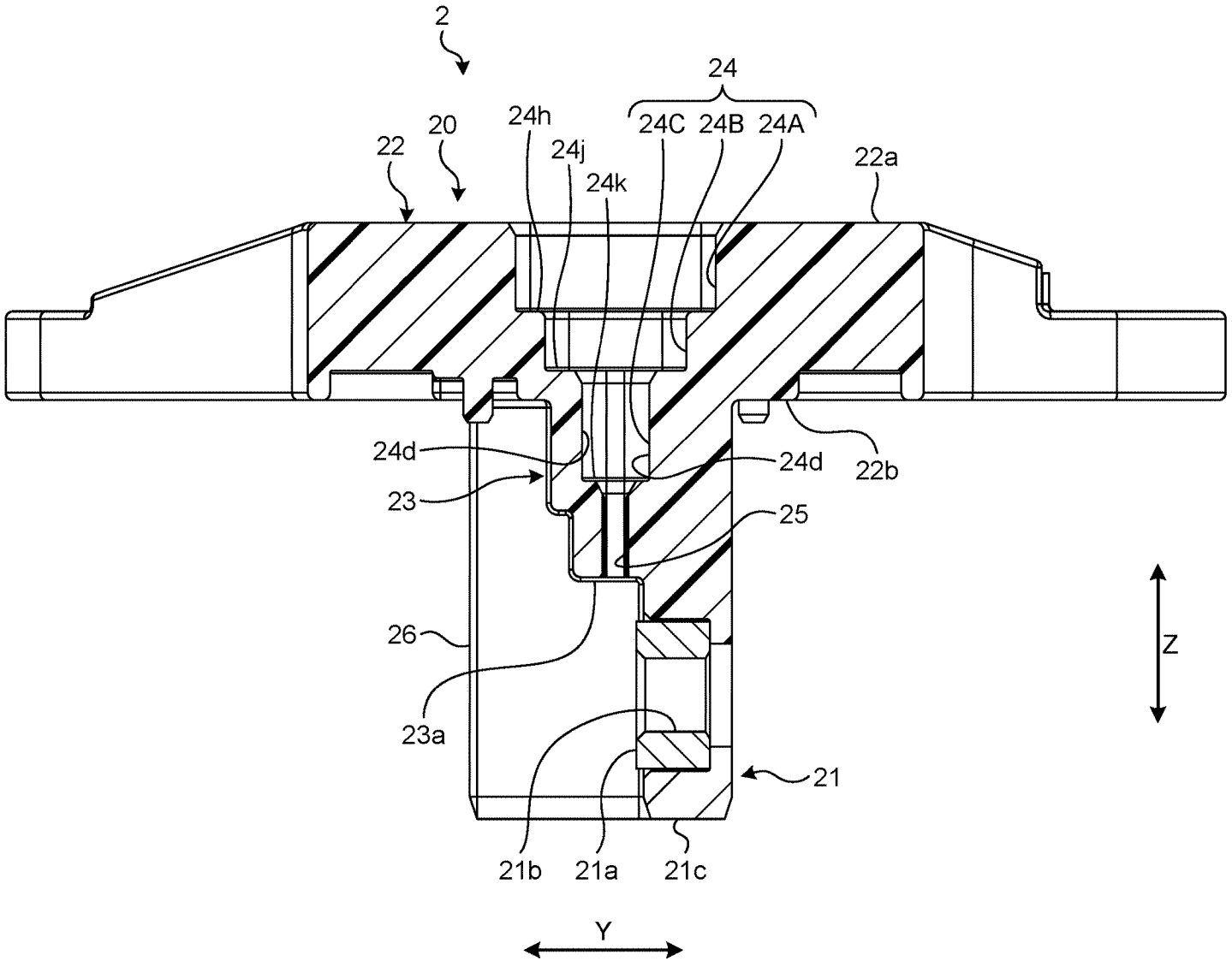
FIG. 7 is a sectional view of the housing according to the first embodiment.

FIG. 7 illustrates a section taken along line VII-VII of FIG. 5. FIG. 9 illustrates a section taken along line IX-IX of FIG. 8. FIG. 10 illustrates a section taken along line X-X of FIG. 8.

Figure 2:
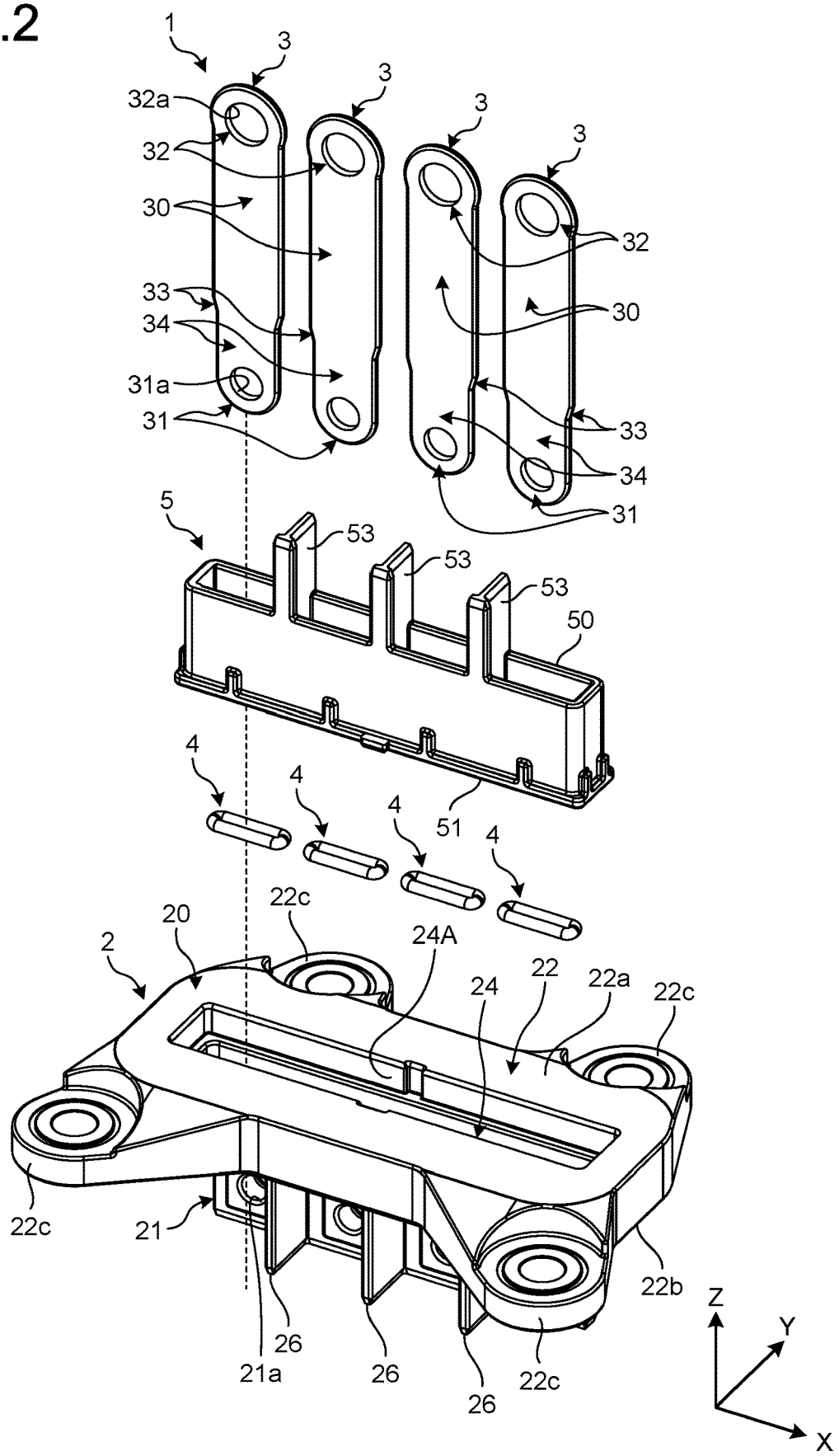
FIG. 2 is an exploded perspective view of the connector according to the first embodiment.

As illustrated in FIG. 1 and FIG. 2, a connector 1 according to the embodiment has a housing 2, a plurality of conductors 3, a plurality of sealing members 4, and a support member 5. The connector 1 electrically connects a first device 100 and a second device 200. In the present embodiment, the first device 100 is a motor and the second device 200 is an inverter. The first device 100 and the second device 200 are mounted on a vehicle such as an automobile, for example. A motor body 103 of the first device 100 and an inverter body 203 of the second device 200 are electrically connected via the conductors 3.

The second device 200 is interposed between a battery mounted on the vehicle and the first device 100. The second device 200 has a conversion function between a direct current and an alternating current and a transformation function of stepping up and down a voltage. The supply of electric power from the battery to the first device 100 is controlled by the second device 200. Furthermore, electric power generated by regeneration in the first device 100 is stored in the battery via the second device 200.

The first device 100 has a casing 101 and the motor body 103. The motor body 103 is a main component of the first device 100 and includes a rotor and a stator. The motor body 103 is disposed in an internal space 102 of the casing 101. In the internal space 102 of the casing 101, a first liquid 104 is stored. The first liquid 104 is a liquid having a lubricating function and a cooling function for the motor body 103, and is, for example, oil. An upper wall part 101*a* of the casing 101 has an opening 101*b*. The opening 101*b* penetrates the wall part 101*a* and allows the internal space 102 of the casing 101 and an external space of the casing 101 to communicate with each other.

The second device 200 has a casing 201 and the inverter body 203. The inverter body 203 is a main component of the second device 200 and includes a switching circuit. The inverter body 203 is disposed in an internal space 202 of the casing 201. A pipe 204 is provided in the internal space 202 of the casing 201. A second liquid 205 for cooling is supplied to the inverter body 203 via the pipe 204. The second liquid 205 is, for example, coolant. A lower wall part 201*a* of the casing 201 has an opening 201*b*.

The casing 101 and the casing 201 are fixed to each other while the opening 101*b* and the opening 201*b* face each other. A gasket 300 is interposed between the wall part 101*a* of the casing 101 and the wall part 201*a* of the casing 201.

The connector 1 is fixed to the casing 101 of the first device 100 at a communication part 10 through which the opening 101*b* of the first device 100 and the opening 201*b* of the second device 200 communicate with each other. The communication part 10 is a part where the opening 101*b* of the first device 100 and the opening 201*b* of the second device 200 face each other. In the present embodiment, the opening 201*b* of the second device 200 is larger than the opening 101*b* of the first device 100. Accordingly, the wall part 101*a* of the first device 100 is exposed toward the internal space 202 of the second device 200.

As illustrated in FIG. 1 to FIG. 3, each of the conductors 3 of the present embodiment is a bus bar. The number of the conductors 3 included in the connector 1 of the present embodiment is four. However, the number of the conductors 3 is not limited to four. The conductor 3 is made of a conductive metal, for example, copper, aluminum, and the like. The conductor 3 is formed, for example, by being punched out from a metal plate as a base material. The conductor 3 has a body 30, a first terminal part 31, a second terminal part 32, a taper part 33, and a plate-shaped part 34. The body 30 has a rectangular plate shape. The body 30 is located at an intermediate part between the first terminal part 31 and the second terminal part 32.

The first terminal part 31 is located on one end side in a longitudinal direction with respect to the body 30. The first terminal part 31 is connected to the body 30 via the taper part 33 and the plate-shaped part 34. The first terminal part 31 is electrically connected to a terminal included in the first device 100. The first terminal part 31 has a circular shape, for example. A width W1 of the first terminal part 31 is narrower than a width W0 of the body 30. The first terminal part 31 has a through-hole 31*a* into which a fastening member is inserted.

The second terminal part 32 is located on the other end side in the longitudinal direction with respect to the body 30, and is continuous with the body 30. The second terminal part 32 is electrically connected to a terminal included in the second device 200. The second terminal part 32 has a circular shape, for example. The second terminal part 32 has a through-hole 32*a* into which a fastening member is inserted. An outer diameter W2 of the second terminal part 32 is larger than the width W1 of the first terminal part 31. The outer diameter W2 of the second terminal part 32 is larger than the width W0 of the body 30.

Each of the conductors 3 is inserted into the housing 2 with the first terminal part 31 as a head. In the present embodiment, the longitudinal direction of the conductor 3 is referred to as a "height direction Z". Furthermore, a direction in which the conductors 3 are arranged is referred to as a "first direction X". The first direction X is orthogonal to the height direction Z. A direction orthogonal to both the first direction X and the height direction Z is referred to as a "second direction Y". The second direction Y is a thickness direction of the conductor 3.

The plate-shaped part 34 is a rectangular plate-shaped part that connects the taper part 33 and the first terminal part 31. A width W4 of the plate-shaped part 34 is equal to the width W1 of the first terminal part 31 and is constant along the height direction Z. The taper part 33 is a part in which a width W3 changes along the height direction Z. The width W3 of the taper part 33 becomes narrower from the body 30 toward the plate-shaped part 34. The value of the width W3 of the taper part 33 is equal to the width W0 of the body 30 at an end portion connected to the body 30. Furthermore, the value of the width W3 of the taper part 33 is equal to the width W4 of the plate-shaped part 34 at an end portion connected to the plate-shaped part 34.

An edge part of the conductor 3 is chamfered. Due to the chamfering process, the sectional shapes of the edge parts of the body 30, the first terminal part 31, the second terminal part 32, the taper part 33, and the plate-shaped part 34 are substantially arc shapes.

As illustrated in FIG. 2, the housing 2 has a body 20 and a wall part 21. The body 20 and the wall part 21 are integrally molded of an insulating synthetic resin, for example. The material of the housing 2 is resistant to the first liquid 104. The material of the housing 2 is, for example, an oil-resistant synthetic resin. The body 20 is a part fixed to the wall part 101*a* of the first device 100. As illustrated in FIG. 5 and the like, the body 20 has a base 22 formed in a plate shape and a protruding part 23 protruding toward the height direction Z from the base 22. The wall part 21 protrudes toward the height direction Z from a tip end of the protruding part 23.

As illustrated in FIG. 4, the base 22 has a substantially rectangular planar shape. The longitudinal direction of the base 22 is the first direction X. The base 22 is provided at the four corners thereof with fixed parts 22*c* each having through-holes. The fixed parts 22*c* are fixed to the wall part 101*a* of the first device 100 by, for example, bolts. The base 22 has a first surface 22*a* and a second surface 22*b*. The second surface 22*b* is a surface on which the protruding part 23 is provided. The first surface 22*a* is a surface opposite to the second surface 22*b*. The base 22 is fixed with the first surface 22*a* facing the second device 200 and with the second surface 22*b* facing the wall part 101*a*. The first surface 22*a* faces upward when the first device 100 and the second device 200 are installed in a vehicle, for example.

As illustrated in FIG. 5 and FIG. 6, the protruding part 23 protrudes toward the height direction Z from the second surface 22*b* of the base 22. The protruding part 23 has a substantially rectangular parallelepiped shape. The protruding part 23 in a section orthogonal to the height direction Z has a substantially sectional rectangular shape. In the sectional shape of the protruding part 23, the longitudinal direction is the first direction X.

As illustrated in FIG. 2 and FIG. 4, the body 20 has a recess 24 formed in multiple stages. The recess 24 is open to the first surface 22*a* of the base 22 and is recessed toward the wall part 21 along the height direction Z. The recess 24 has a first recess 24A, a second recess 24B, and third recesses 24C. The first recess 24A is fitted to the support member 5 and supports the support member 5 from below. A protrusion 52 of the support member 5 is fitted in the second recess 24B. The sealing members 4 are inserted into the third recesses 24C.

As illustrated in FIG. 4, the first recess 24A has a substantially rectangular planar shape. The longitudinal direction of the first recess 24A is the first direction X. The first recess 24A has a first wall surface 24*f* and a second wall surface 24*g* facing each other in the second direction Y. The first wall surface 24*f* and the second wall surface 24*g* are surfaces along the first direction X and the height direction Z.

The second recess 24B is recessed along the height direction Z from a bottom surface 24*h* of the first recess 24A toward the wall part 21 side. The second recess 24B has a substantially rectangular planar shape. The longitudinal direction of the second recess 24B is the first direction X. The third recesses 24C are recessed along the height direction Z from a bottom surface 24*j* of the second recess 24B toward the wall part 21 side. The recess 24 of the present embodiment has a plurality of third recesses 24C. The number of the third recesses 24C is set to four in accordance with the number of the conductors 3 and the number of the sealing members 4. The four third recesses 24C are arranged in a row along the first direction X. The four third recesses 24C are disposed at equal intervals, for example.

The shape of the third recess 24C in a plan view is a flat shape. The longitudinal direction of the third recess 24C is the first direction X. The planar shape of the third recess 24C is a shape corresponding to the planar shape of the sealing member 4. The inner wall surface of the third recess 24C has a pair of first wall surfaces 24*d* and 24*d* and a pair of second wall surfaces 24*e* and 24*e*. The first wall surfaces 24*d* and 24*d* face each other in the second direction Y. The first wall surface 24*d* is a surface substantially orthogonal to the second direction Y. The second wall surface 24*e* connects the end portions of the pair of first wall surfaces 24*d* and 24*d*. The shape of the second wall surface 24*e* in a plan view is a convex shape toward the outside along the first direction X. The planar shape of the second wall surface 24*e* of the present embodiment is a substantially arc shape.

As illustrated in FIG. 4, the body 20 has a plurality of first through-holes 25. The conductors 3 are press-fitted into the first through-holes 25, respectively, and held by the first through-holes 25. Each of the first through-holes 25 has a sectional shape corresponding to that of the conductor 3, and has a substantially rectangular shape, for example. The longitudinal direction in the sectional shape of the first through-hole 25 is the first direction X. The number of the first through-holes 25 included in the body 20 is four in accordance with the number of the conductors 3 to be inserted. The first through-holes 25 are disposed at equal intervals along the first direction X.

The first through-holes 25 penetrate the body 20 along the height direction Z. One end of the first through-hole 25 is open to a bottom surface 24*k* of the third recess 24C. The other end of the first through-hole 25 is open to a tip end surface 23*a* of the protruding part 23. One first through-hole 25 is disposed for one third recess 24C.

The wall part 21 is a rectangular flat plate-shaped component part and protrudes toward the height direction Z from the tip end surface 23*a* of the protruding part 23. As illustrated in FIG. 5, FIG. 7 and the like, the wall part 21 holds nuts 21*a*. Four nuts 21*a* are fixed to the wall part 21 of the present embodiment in correspondence with the four conductors 3. The nuts 21*a* are integrally formed with the wall part 21 by molding, for example. A screw hole 21*b* of each of the nuts 21*a* extends along the second direction Y. The first terminal part 31 of the conductor 3 and the terminal of the first device 100 are co-fastened to the nut 21*a* by a bolt.

The housing 2 has a plurality of insulating walls 26. Each of the insulating walls 26 is a wall that divides between the adjacent conductors 3. The housing 2 of the present embodiment has three insulating walls 26 in correspondence with the four conductors 3. The insulating walls 26 protrude toward the second direction Y from the side surface of the protruding part 23 and the wall part 21. The insulating walls 26 extend along the height direction Z from the second surface 22*b* of the base 22 to a tip end surface 21*c* of the wall part 21.

As illustrated from FIG. 8 to FIG. 10, the sealing member 4 has a sealing part 40. The sealing member 4 is integrally molded of a resin such as rubber. The material of the sealing member 4 is a material having resistant to the first liquid 104, and is, for example, oil-resistance acrylic rubber and the like. The sealing part 40 is a part that seals between the conductor 3 and the housing 2. In the present embodiment, the entire sealing member 4 serves as the sealing part 40. However, the sealing member 4 may have a part other than the sealing part 40. As illustrated in FIG. 8, the shape of the sealing part 40 in a plan view is a flat annular shape. The sealing part 40 has a pair of first sealing parts 41 and 41 and a pair of second sealing parts 42 and 42.

The first sealing part 41 is a linear part extending in the longitudinal direction of the sealing part 40. The sealing member 4 is inserted into the third recess 24C of the housing 2 such that the longitudinal direction of the sealing part 40 coincides with the first direction X and the short direction of the sealing part 40 coincides with the second direction Y. In the following description of the sealing member 4, the first direction X, the second direction Y, and the height direction Z are directions when the sealing member 4 has been attached to the housing 2.

As illustrated in FIG. 9, the sectional shape of the first sealing part 41 is circular. That is, the shape of the first sealing part 41 is a columnar shape. The pair of first sealing parts 41 and 41 is parallel and one of the first sealing parts 41 and the other first sealing part 41 are separated from each other in the second direction Y.

The second sealing part 42 is an arc-shaped part that connects the end portions of the pair of first sealing parts 41 and 41. The shape of the second sealing part 42 in a plan view is a curved shape that is convex in a direction away from the first sealing part 41. The planar shape of the second sealing part 42 of the present embodiment is a substantially semicircle. More specifically, the second sealing part 42 has two arc portions 42*a* and one linear portion 42*b*. The planar shape of the arc portion 42*a* is an arc shape having a central angle of 90°. One end 42*c* of the arc portion 42*a* is connected to the end portion of the first sealing part 41. The other end 42*d* of the arc portion 42*a* is connected to the linear portion 42*b*.

The linear portion 42*b* is a linear portion extending in the second direction Y. The linear portion 42*b* connects the two arc portions 42*a*. The linear portion 42*b* is located at the center of the second sealing part 42 in the second direction Y. The linear portion 42*b* is provided at a position facing the conductor 3 in the first direction X. As illustrated in FIG. 10, the sectional shape of the linear portion 42*b* is circular. Furthermore, the sectional shape of the arc portion 42*a* is the same circular shape as that of the linear portion 42*b*. In the sealing part 40 of the present embodiment, the sectional shape and sectional area of the first sealing part 41 and the sectional shape and sectional area of the second sealing part 42 are substantially the same.

A hole 43 is formed by the pair of first sealing parts 41 and 41 and the pair of second sealing parts 42 and 42. The conductor 3 is inserted into the hole 43. The shape of the hole 43 in a plan view is a flat shape, for example, a substantially rectangular shape.

FIG. 8 illustrates the thickness D1 of the first sealing part 41 and the thickness D2 of the second sealing part 42 in a plan view. The thicknesses D1 and D2 are thicknesses when the sealing part 40 is not received in the third recess 24C. In other words, the thicknesses D1 and D2 are thicknesses when no external force acts on the sealing part 40.

In the present embodiment, the thickness D1 of the first sealing part 41 is equal to a diameter of the first sealing part 41 in the sectional shape thereof. Furthermore, the thickness D2 of the second sealing part 42 is equal to a diameter of the second sealing part 42 in the sectional shape thereof. In the sealing part 40 of the present embodiment, the thickness D1 of the first sealing part 41 and the thickness D2 of the second sealing part 42 are equal to each other. Note that the thickness D2 of the second sealing part 42 is, for example, the thickness of the sealing part 40 at a position on the long axis thereof, in other words, a thickness at a position facing the side surface of the conductor 3. In the present embodiment, the linear portion 42*b* is located on the long axis of the sealing part 40 and faces the side surface of the conductor 3. In such a case, the thickness of the linear portion 42*b* represents the thickness D2 of the second sealing part 42.

An inner dimension Ws1 of the sealing part 40 in the first direction X is determined according to the dimension of the conductor 3. The inner dimension Ws1 is a length of the hole 43. In other words, the inner dimension Ws1 is a distance along the first direction X from an inner edge of one of the linear portions 42*b* to an inner edge of the other linear portion 42*b*. Note that the inner dimension Ws1 is a dimension when the sealing part 40 is not received in the third recess 24C. An inner dimension Ws2 and external dimensions Ws3 and Ws4 to be described later are also dimensions when the sealing part 40 is not received in the third recess 24C.

The inner dimension Ws1 is smaller than the width W0 of the body 30 of the conductor 3 and is equal to or more than the width W4 of the plate-shaped part 34 of the conductor 3. That is, the size of the inner dimension Ws1 is set such that the plate-shaped part 34 can be easily inserted into the hole 43. Furthermore, the size of the inner dimension Ws1 is determined such that the sealing part 40 is expanded by the body 30 toward the first direction X.

The inner dimension Ws2 of the sealing part 40 in the second direction Y is determined according to the dimension of the conductor 3. The inner dimension Ws2 is a width of the hole 43. In other words, the inner dimension Ws2 is a distance from an inner edge of one of the first sealing parts 41 to an inner edge of the other first sealing part 41. The inner dimension Ws2 is smaller than a plate thickness t of the conductor 3. Note that in the conductor 3 of the present embodiment, a plate thickness t is uniform from the first terminal part 31 to the second terminal part 32.

The outer dimension Ws3 of the sealing part 40 in the first direction X is associated with the dimension of the third recess 24C. The outer dimension Ws3 is a distance along the first direction X from an outer edge of the one linear portion 42*b* to an outer edge of the other linear portion 42*b*. The outer dimension Ws3 has the same value as that of an inner dimension Wc1 (see FIG. 11) of the third recess 24C in the first direction X.

The outer dimension Ws4 of the sealing part 40 in the second direction Y is associated with the dimension of the third recess 24C. The outer dimension Ws4 is a distance along the second direction Y from an outer edge of the one first sealing part 41 to an outer edge of the other first sealing part 41. The outer dimension Ws4 has a value larger than that of an inner dimension Wc2 (see FIG. 11) of the third recess 24C in the second direction Y.

That is, the sealing part 40 of the present embodiment is compressed along the second direction Y when the sealing part 40 is received in the third recess 24C. On the other hand, the sealing part 40 is not substantially compressed along the first direction X when the sealing part 40 is received in the third recess 24C.

Figure 13:
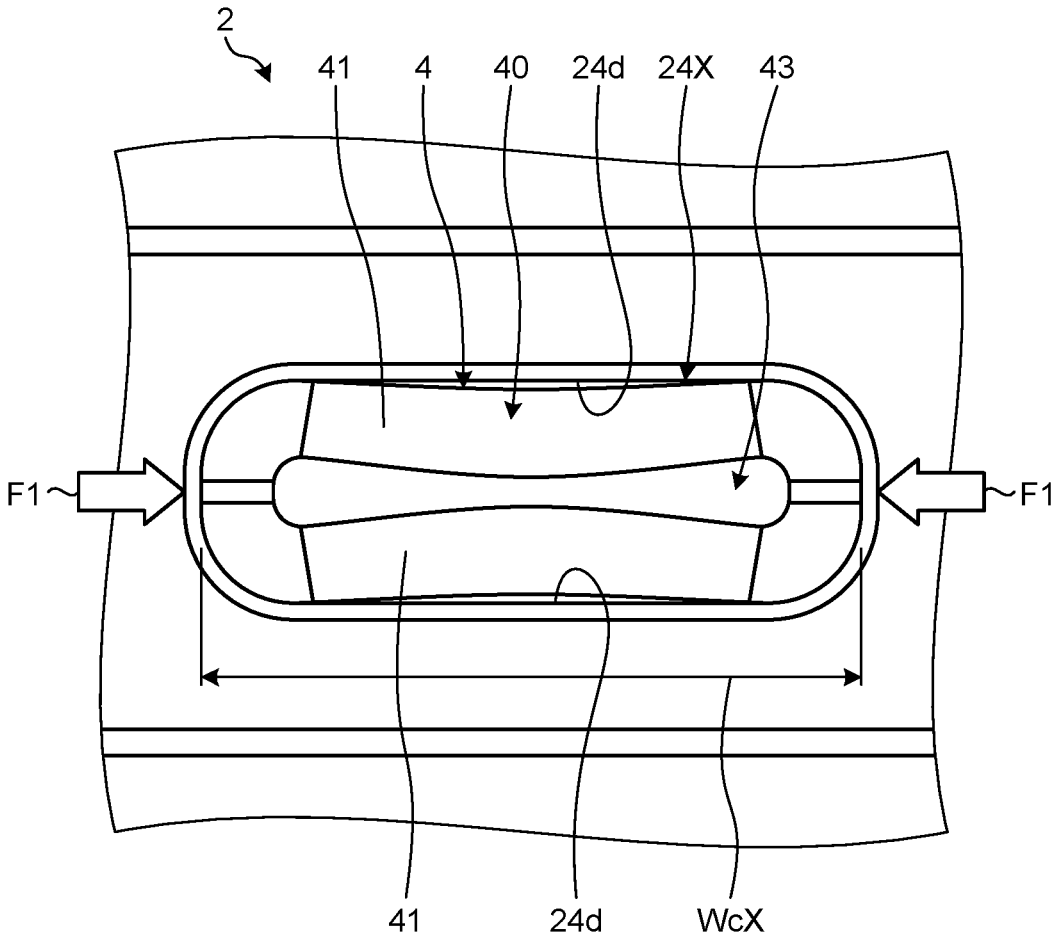
FIG. 13 is a plan view of a sealing member received in a recess of a comparative example.
Figure 14:
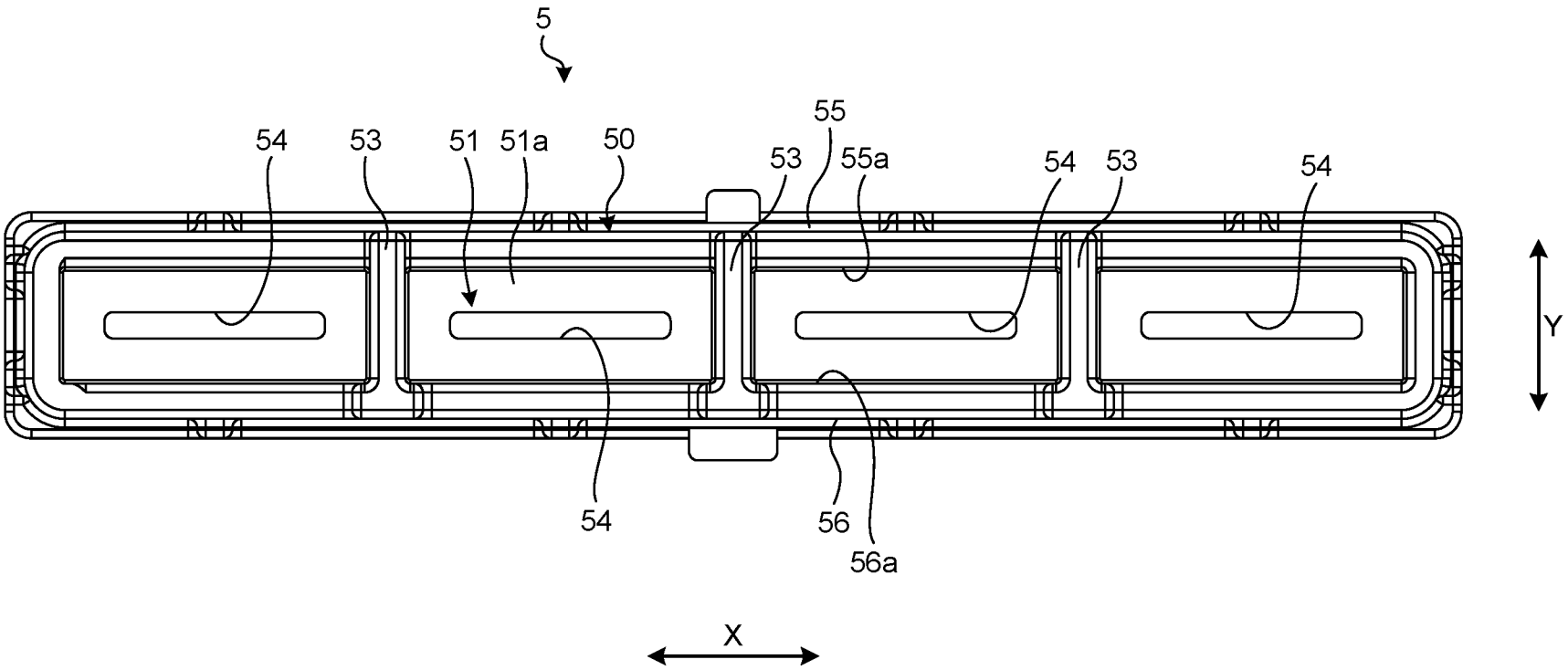
FIG. 14 is a plan view of a support member according to the first embodiment.

FIG. 12 illustrates the sealing member 4 received in the third recess 24C. FIG. 13 illustrates the sealing member 4 received in a recess 24X of a comparative example. The recess 24X of the comparative example is different from the third recess 24C of the present embodiment in that the size of an inner dimension WcX in the first direction X is smaller than the outer dimension Ws3 of the sealing part 40. In such a case, compressive force F1 in the first direction X acts on the sealing part 40 received in the recess 24X. Due to the compressive force F1, the first sealing part 41 is likely to be deformed so as to be bent inward. This deformation causes the central parts of the pair of first sealing parts 41 and 41 to be brought closer to each other. In other words, the first sealing part 41 is deformed so as to narrow the opening width of the hole 43.

On the other hand, as illustrated in FIG. 12, in the connector 1 of the present embodiment, the deformation of the sealing part 40 received in the third recess 24C is suppressed. Compressive force in the first direction X does not substantially act on the sealing part 40 of the present embodiment or even though the compressive force in the first direction X acts thereon, the magnitude of the compressive force is not large enough to bend the first sealing part 41. Accordingly, as illustrated in FIG. 12, the sealing part 40 is received in the third recess 24C while the first sealing part 41 maintains the linear shape. That is, the sealing part 40 is less likely to be deformed to narrow the opening width of the hole 43.

Thus, in the connector 1 of the present embodiment, when the conductor 3 is inserted into the hole 43, the conductor 3 is less likely to interfere with the first sealing part 41. As a consequence, in the connector 1 of the present embodiment, the conductor 3 is prevented from damaging the sealing part 40 or from rolling the sealing part 40.

As illustrated in FIG. 14 to FIG. 17, the support member 5 has a tubular part 50, a bottom wall part 51, the protrusion 52, and insulating walls 53. The tubular part 50, the bottom wall part 51, the protrusion 52, and the insulating walls 53 are integrally molded of an insulating synthetic resin, for example. The material of the support member 5 is resistant to the second liquid 205. Note that the material of the support member 5 may be a material not resistant to the first liquid 104 or a material having low resistant to the first liquid 104 relative to the material of the housing 2.

The tubular part 50 has a rectangular tubular shape. The outer shape of the tubular part 50 in a plan view is a rectangle. The longitudinal direction of the tubular part 50 is the first direction X. The tubular part 50 has a first wall part 55 and a second wall part 56 facing each other in the second direction Y. The bottom wall part 51 is a wall part that closes one opening of the tubular part 50. An inner surface 51*a* of the bottom wall part 51 is a surface facing the second device 200. The inner surface 51*a* is a surface facing upward when the first device 100 and the second device 200 are installed in a vehicle, for example.

Figure 15:
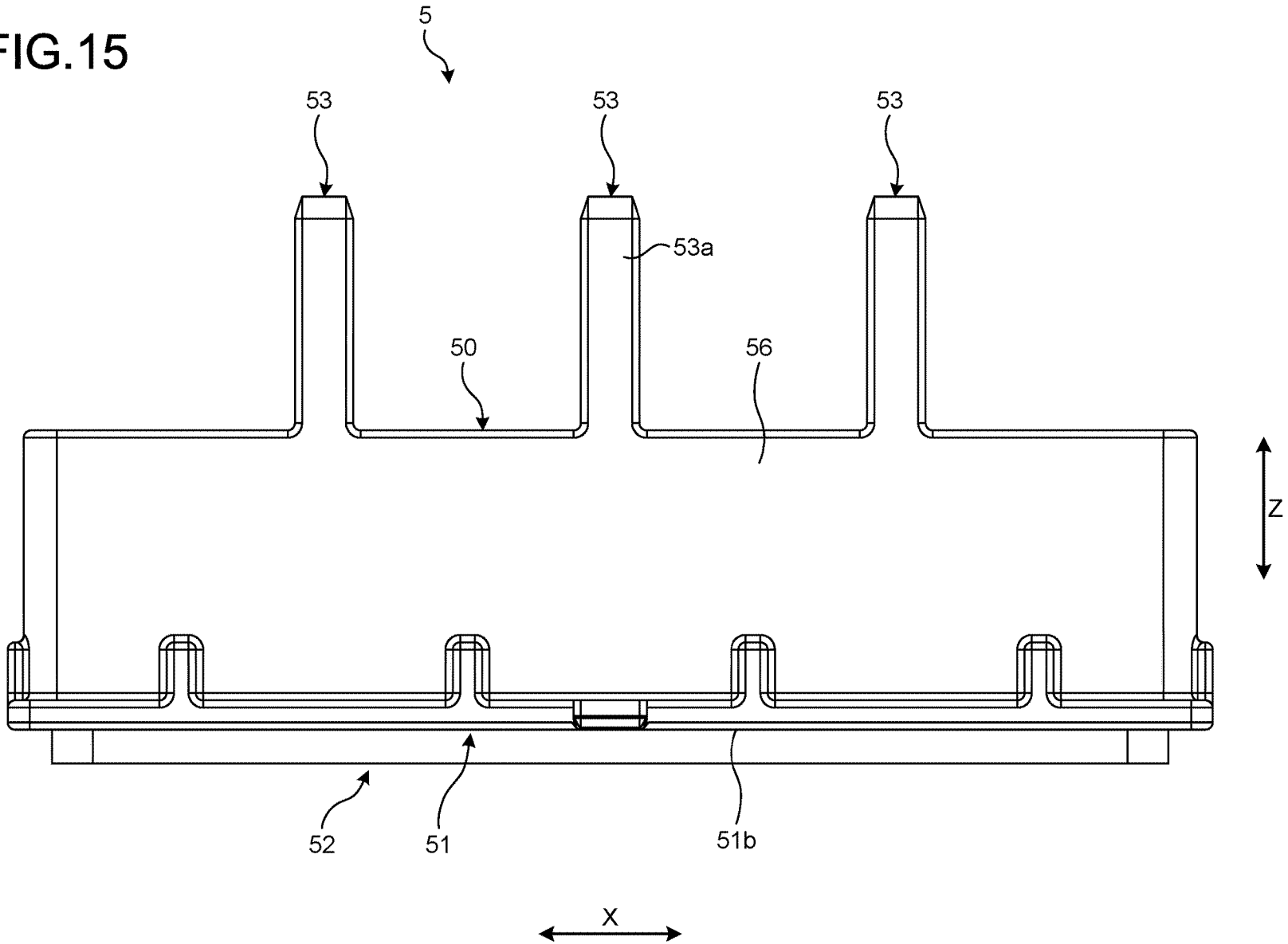
FIG. 15 is a front view of the support member according to the first embodiment.
Figure 16:
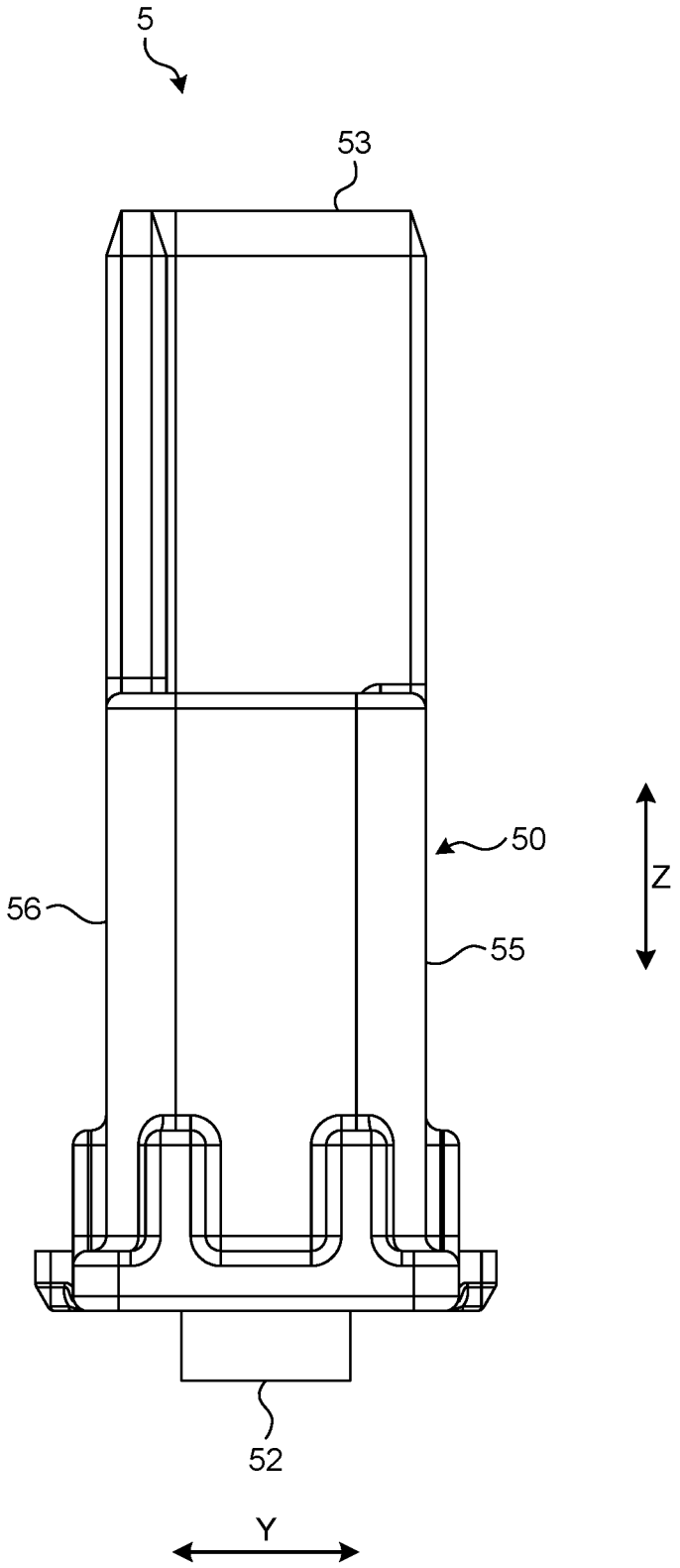
FIG. 16 is a side view of the support member according to the first embodiment.
Figure 17:
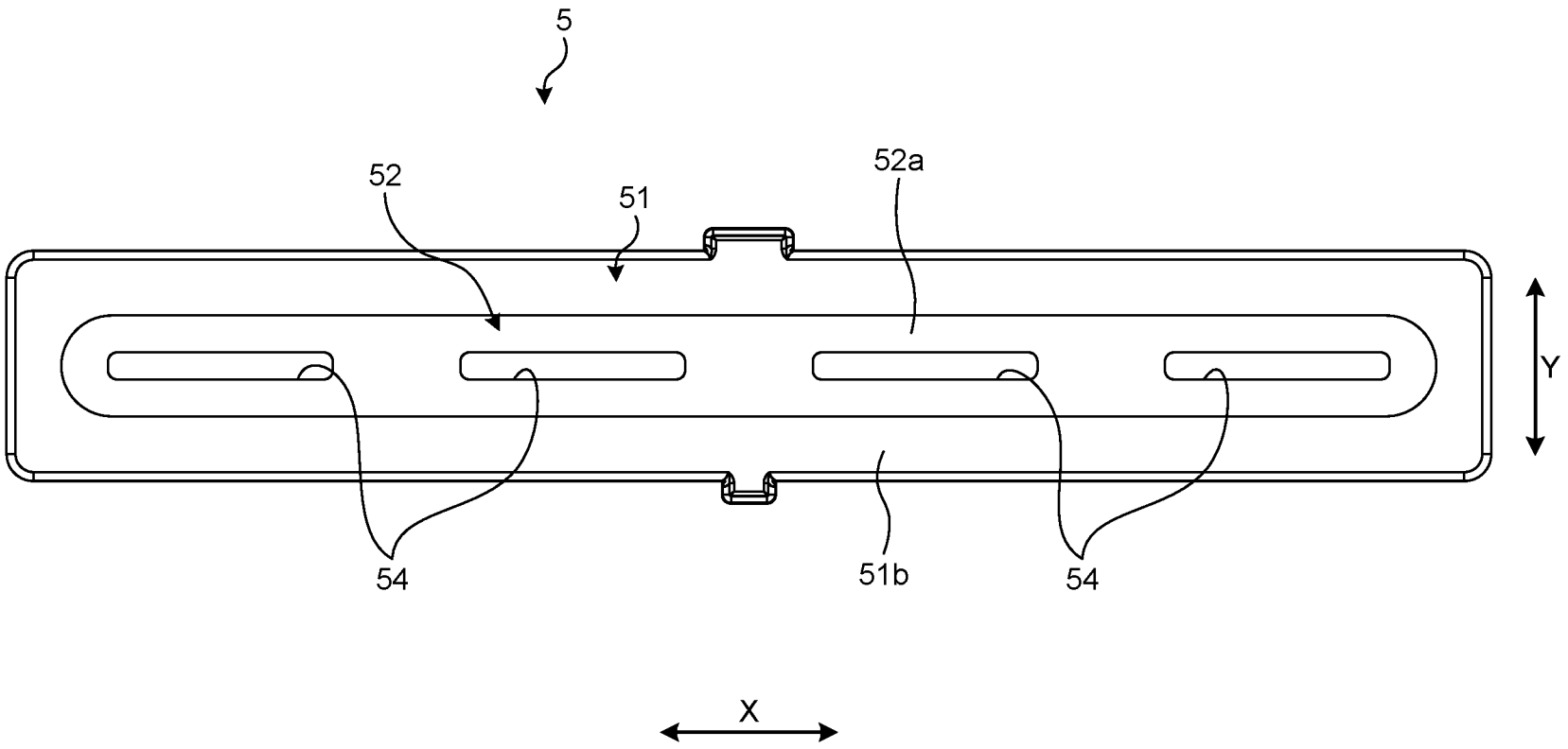
FIG. 17 is a bottom view of the support member according to the first embodiment.

As illustrated in FIG. 15 to FIG. 17, the protrusion 52 protrudes along the height direction Z from an outer surface 51*b* of the bottom wall part 51. The protrusion 52 serves as an O-ring stopper that supports the sealing member 4. The support member 5 supports the sealing members 4 by one protrusion 52.

The support member 5 has a plurality of second through-holes 54 into which the conductors 3 are inserted, respectively. Each of the second through-holes 54 has a substantially sectional rectangular shape. The longitudinal direction in the sectional shape of the second through-hole 54 is the first direction X. The support member 5 has four second through-holes 54 in correspondence with the four conductors 3. The four second through-holes 54 are arranged along the first direction X. The four second through-holes 54 are disposed at equal intervals, for example. The second through-holes 54 penetrate the bottom wall part 51 and the protrusion 52 along the height direction Z. One end of the second through-hole 54 is open to the inner surface 51*a* of the bottom wall part 51. The other end of the second through-hole 54 is open to a tip end surface 52*a* of the protrusion 52. The four second through-holes 54 are formed for one protrusion 52. The tip end surface 52*a* closes the third recess 24C, and supports the sealing part 40 such that the sealing part 40 does not come out of the third recess 24C.

The insulating walls 53 are walls that divide between the adjacent conductors 3. The insulating walls 53 are connected to an inner surface 55*a* of the first wall part 55, an inner surface 56*a* of the second wall part 56, and the inner surface 51*a* of the bottom wall part 51, and divide the internal space of the tubular part 50. Furthermore, each of the insulating walls 53 has a protruding part 53*a* protruding from the tubular part 50 along the height direction Z.

Figure 18:
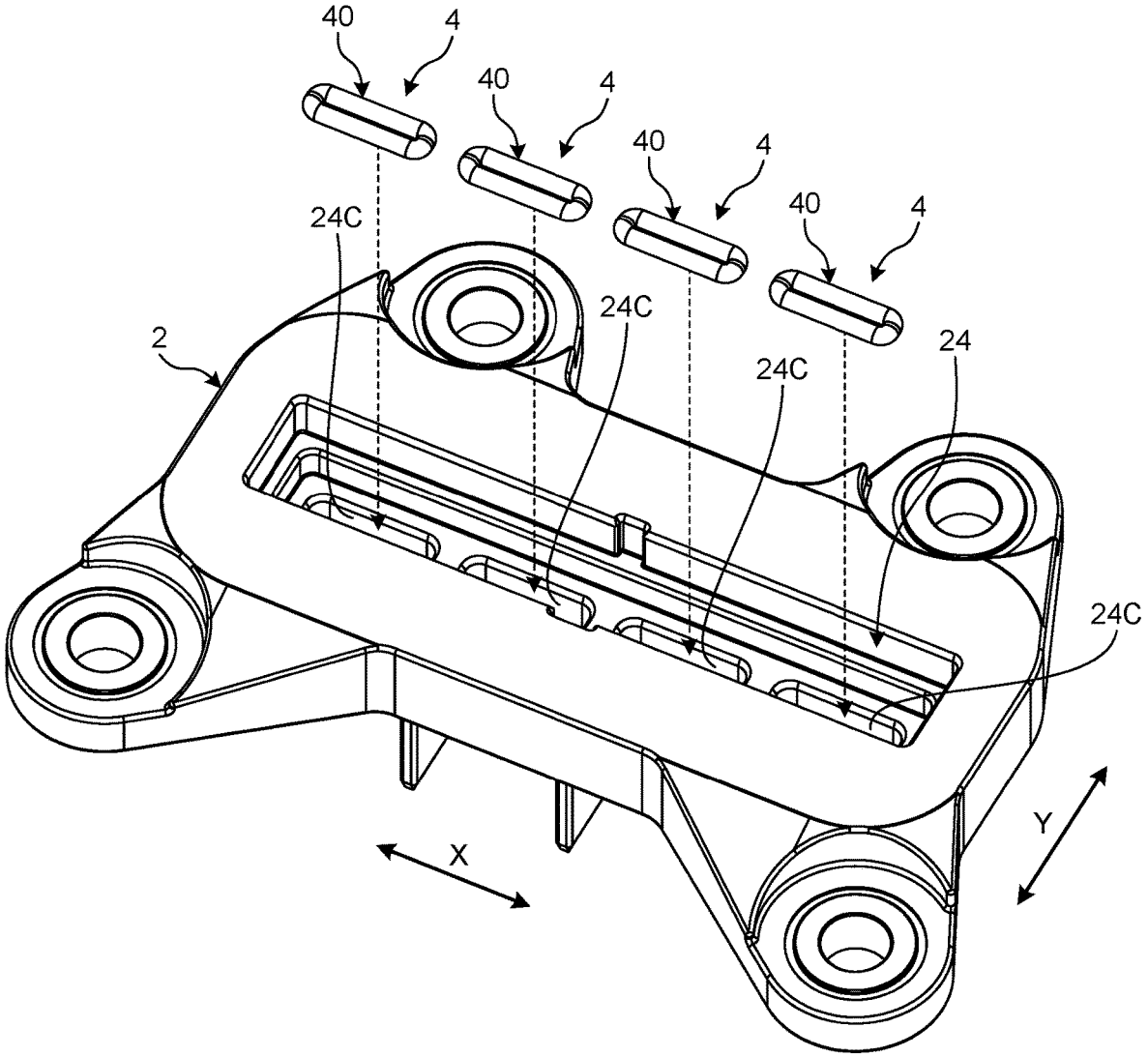
FIG. 18 is a perspective view illustrating attachment of the sealing member to the housing.
Figure 19:
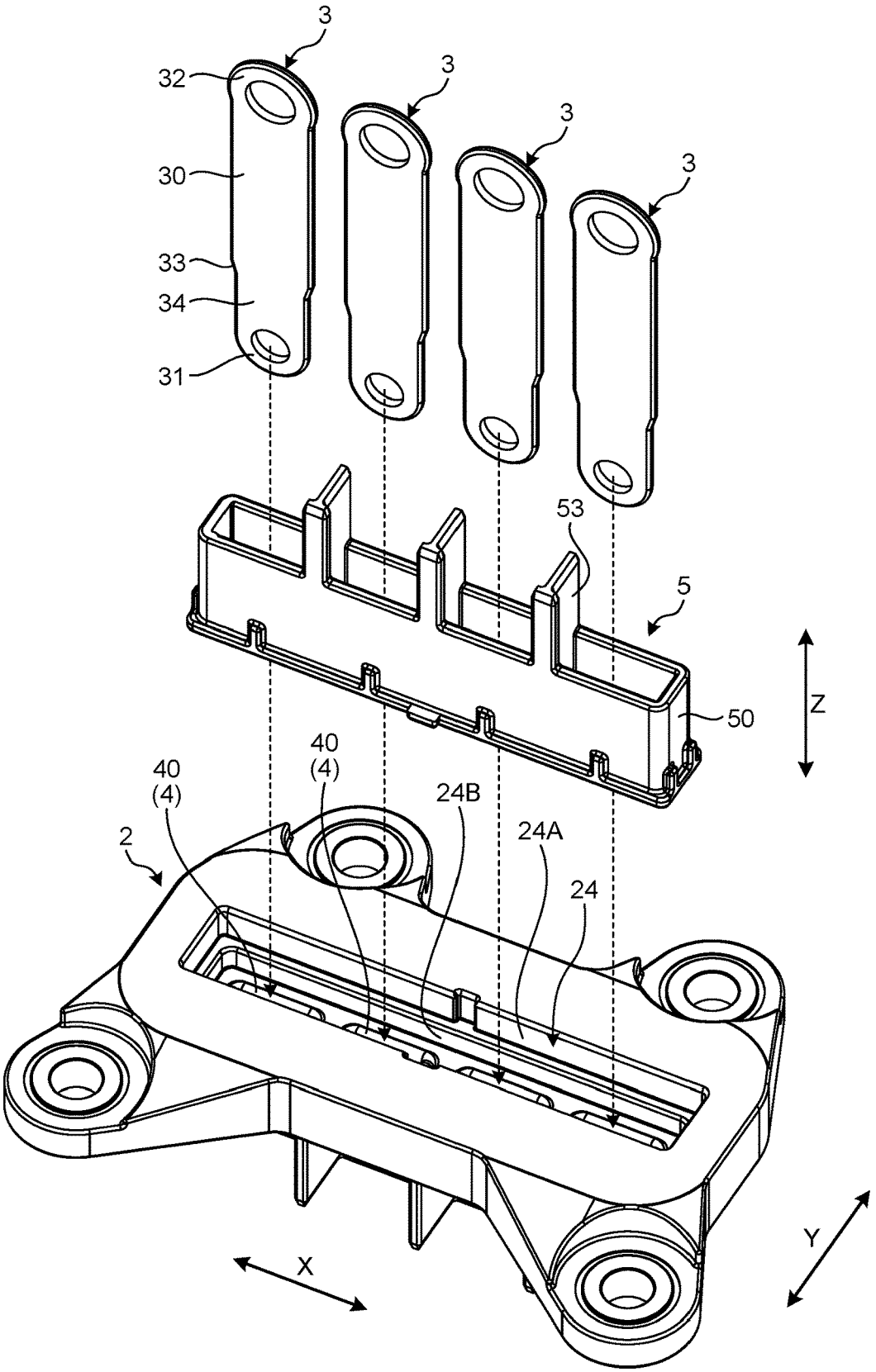
FIG. 19 is a perspective view illustrating attachment of the conductors and the support member to the housing.

The connector 1 of the present embodiment is assembled as follows, for example. First, as illustrated in FIG. 18, the sealing members 4 are inserted into the third recesses 24C of the housing 2, respectively. One sealing member 4 is inserted into one third recess 24C. Next, as illustrated in FIG. 19, the support member 5 and the conductors 3 are attached to the housing 2. The tubular part 50 of the support member 5 is fitted into the first recess 24A, and the protrusion 52 of the support member 5 is fitted into the second recess 24B. The conductors 3 are inserted into the second through-holes 54 of the support member 5, the holes 43 of the sealing member 4, and the first through-holes 25 of the housing 2. At this time, the conductor 3 is inserted into the hole 43 while expanding the sealing part 40 toward the inner wall surface of the third recess 24C.

The support member 5 and the conductors 3 may be attached to the housing 2 at the same time or separately. In the former assembly method, the conductors 3 are inserted into the second through-holes 54 of the support member 5, and then the support member 5 and the conductors 3 are attached to the housing 2. In the latter assembly method, the support member 5 is first attached to the housing 2, and then the conductors 3 are attached to the support member 5 and the housing 2.

Figure 20:
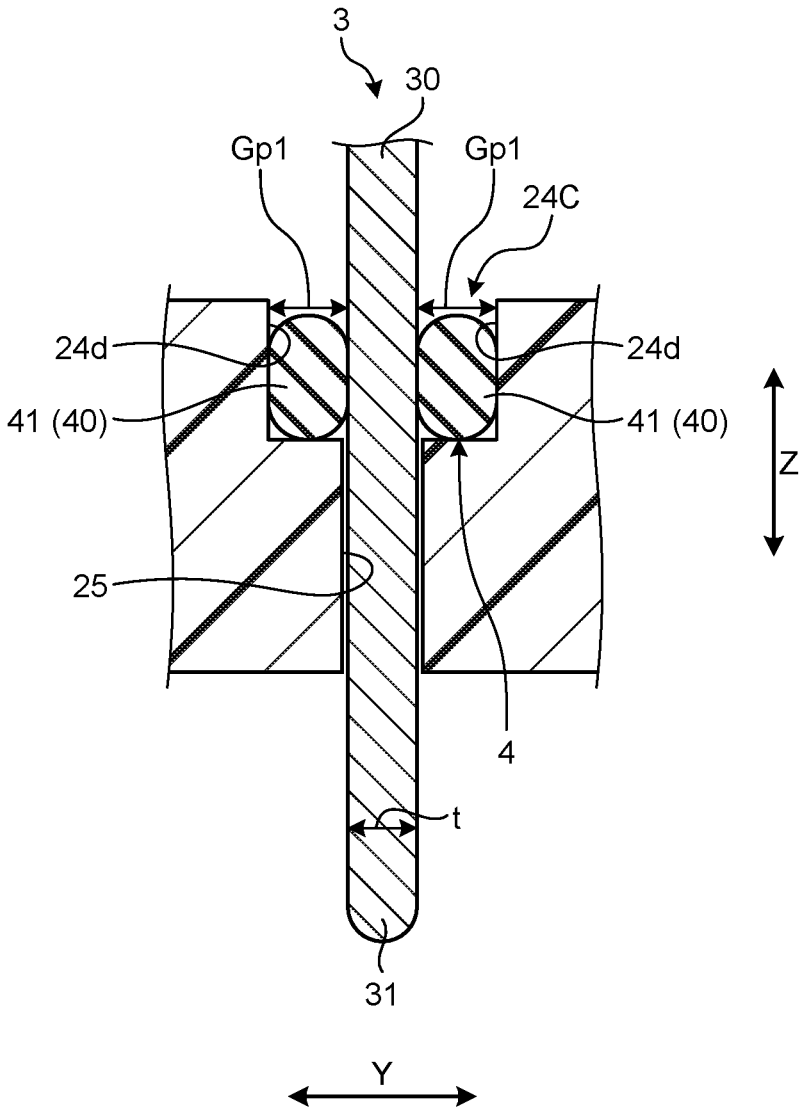
FIG. 20 is a sectional view illustrating a compressed first sealing part.
Figure 21:
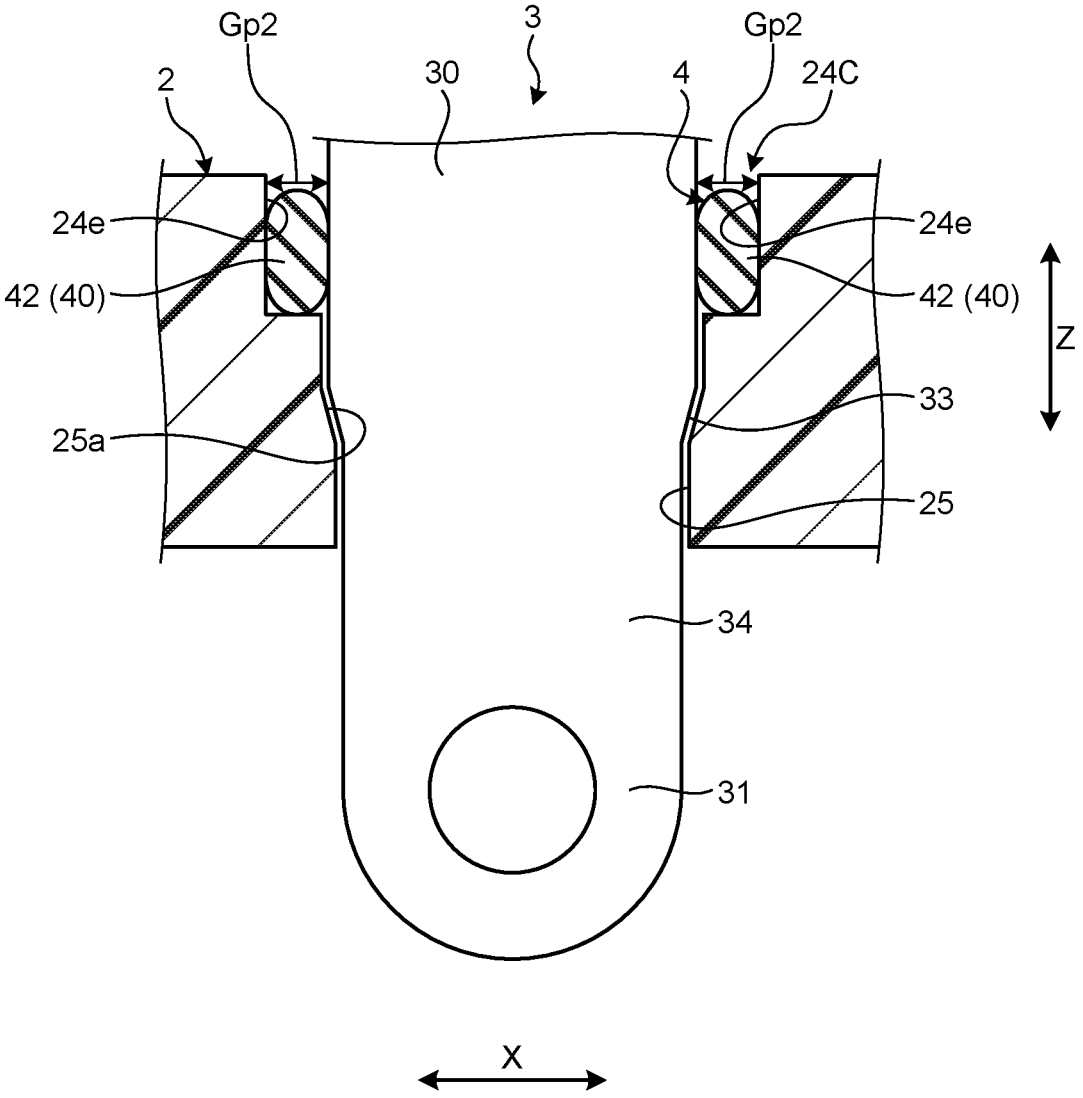
FIG. 21 is a sectional view illustrating a compressed second sealing part.

FIG. 20 and FIG. 21 illustrate the conductor 3 in a held state. The held state of the conductor 3 is a state in which the conductor 3 has been inserted into the first through-hole 25 and held by the housing 2. As illustrated in FIG. 21, the first through-hole 25 has a locking portion 25*a* for positioning the conductor 3. The locking portion 25*a* is a part of the first through-hole 25 and locks the taper part 33 of the conductor 3. The locking portion 25*a* is inclined such that its width in the first direction X becomes narrower as it goes downward. The inclination angle of the locking portion 25*a* is equal to that of the taper part 33, for example. The locking portion 25*a* positions the conductor 3 in the height direction Z and the first direction X.

As illustrated in FIG. 20, the conductor 3 compresses the first sealing part 41 of the sealing member 4. More specifically, the body 30 of the conductor 3 presses the first sealing part 41 toward the first wall surfaces 24*d* and compresses the first sealing part 41 in the second direction Y. In the following description, a state in which the first sealing part 41 is compressed by the conductor 3 in the held state and the first wall surfaces 24*d* is simply referred to as a compressed state. The width of the first sealing part 41 in the compressed state is determined by a size Gp1 of a gap between the conductor 3 and the first wall surfaces 24*d*. A compression ratio Cp1 at which the conductor 3 and the first wall surfaces 24*d* compress the first sealing part 41 is represented by the following Equation (1).

$$Cp1=(D1-Gp1)/D1\times 100 \quad (1)$$

As illustrated in FIG. 21, the conductor 3 compresses the second sealing part 42 of the sealing member 4. More specifically, the body 30 of the conductor 3 presses the second sealing part 42 toward the second wall surfaces 24*e* and compresses the second sealing part 42 in the first direction X. In the following description, a state in which the second sealing part 42 is compressed by the conductor 3 in the held state and the second wall surfaces 24*e* is simply referred to as a compressed state. The width of the second sealing part 42 in the compressed state is determined by a size Gp2 of a gap between the conductor 3 and the second wall surfaces 24*e*. A compression ratio Cp2 at which the conductor 3 and the second wall surfaces 24*e* compress the second sealing part 42 is represented by the following Equation (2).

$$Cp2=(D2-Gp2)/D2\times 100 \quad (2)$$

The connector 1 of the present embodiment satisfies the following Equation (3). That is, in the connector 1 of the present embodiment, the housing 2, the sealing part 40, and the conductor 3 are designed such that the compression ratio Cp1 of the first sealing part 41 and the compression ratio Cp2 of the second sealing part 42 are equal to each other. Thus, the connector 1 of the present embodiment can both suppress the narrowing of the opening width of the sealing part 40 and make the compression ratios in the sealing part 40 uniform.

$$Cp1=Cp2 \quad (3)$$

As described above, the connector 1 of the present embodiment has the insulating housing 2, the plate-shaped conductors 3, and the sealing parts 40. The housing 2 is fixed to the casing 101 of the first device 100 at the communication part 10 through which the opening 101*b* of the first device 100 and the opening 201*b* of the second device 200 communicate with each other. The housing 2 has the first through-holes 25 that allow the internal space 102 of the first device 100 and the internal space 202 of the second device 200 to communicate with each other. The conductors 3 are inserted into the first through-holes 25, respectively, to electrically connect the first device 100 and the second device 200.

The sealing part 40 has a flat annular shape in a plan view and seals between the conductor 3 and the housing 2. The sealing part 40 has the pair of first sealing parts 41 and 41 and the pair of second sealing parts 42 and 42. The first sealing part 41 is a linear part extending in the longitudinal direction of the sealing part 40. The second sealing part 42 is an arc-shaped part that connects the end portions of the pair of first sealing parts 41 and 41.

The housing 2 has the third recess 24C for receiving the sealing part 40. The third recess 24C has a flat shape in a plan view and is connected the end portion of the first through-hole 25. The inner dimension Wc1 in the longitudinal direction of the third recess 24C is substantially equal to the outer dimension Ws3 in the longitudinal direction of the sealing part 40 when the sealing part 40 is not received in the third recess 24C. The inner dimension Wc2 in the short direction of the third recess 24C is smaller than the outer dimension Ws4 in the short direction of the sealing part 40 when the sealing part 40 is not received in the third recess 24C.

In the held state, the conductor 3 presses and compresses the first sealing part 41 and the second sealing part 42 toward the inner wall surfaces 24*d* and 24*e* of the third recess 24C. The held state is a state in which the conductor 3 has been inserted into the first through-hole 25 and held by the housing 2. According to the connector 1 of the present embodiment, it is possible to suppress the narrowing of the opening width of the sealing part 40. This suppresses the conductor 3 from interfering with the sealing part 40 and damaging the sealing part 40.

In the connector 1 of the present embodiment, the sizes Gp1 and Gp2 of the gaps between the conductor 3 in the held state and the inner wall surfaces 24*d* and 24*e* of the third recess 24C are sizes that allow the compression ratio Cp1 of the first sealing part 41 and the compression ratio Cp2 of the second sealing part 42 to be substantially equal to each other.

The fact that the two compression ratios Cp1 and Cp2 are substantially equal to each other includes not only the fact that the compression ratios Cp1 and Cp2 coincide with each other, but also that the compression ratios Cp1 and Cp2 are different from each other within a certain range. The compression ratio Cp1 of the first sealing part 41 may be larger than the compression ratio Cp2 of the second sealing part 42 or may be smaller than the compression ratio Cp2. The two compression ratios Cp1 and Cp2 may be different from each other within a range in which the sealing part 40 can secure a desired sealability.

In the connector 1 of the present embodiment, the inner wall surface of the third recess 24C has the first wall surface 24*d* and the second wall surface 24*e*. The first wall surface 24*d* is a wall surface facing the first sealing part 41 in the short direction of the third recess 24C. The second wall surface 24*e* is a wall surface facing the second sealing part 42 in the longitudinal direction of the third recess 24C. The connector 1 of the present embodiment satisfies the following Equation (4). Note that the thickness D1 is a thickness of the first sealing part 41 in a plan view when the sealing part 40 is not received in the third recess 24C and the thickness D2 is a thickness of the second sealing part 42 in a plan view when the sealing part 40 is not received in the third recess 24C. Furthermore, the size Gp1 of the gap is the size of the gap between the conductor 3 in the held state and the first wall surface 24*d*, and the size Gp2 of the gap is the size of the gap between the conductor 3 in the held state and the second wall surface 24*e*.

$$Gp1/D1=Gp2/D2 \quad (4)$$

The Equation (4) above indicates that the compression ratio Cp1 of the first sealing part 41 and the compression ratio Cp2 of the second sealing part 42 are equal to each other. That is, in the connector 1 of the present embodiment, it is possible to uniformize the sealability of the first sealing part 41 and the sealability of the second sealing part 42.

Furthermore, the conductor 3 of the present embodiment has the body 30, the first terminal part 31, the second terminal part 32, and the taper part 33. The body 30 is located at an intermediate part in the longitudinal direction of the conductor 3. The first terminal part 31 is located on one end side of the conductor 3 with respect to the body 30, and is connected to the first device 100. The second terminal part 32 is located on the other end side of the conductor 3 with respect to the body 30, and is connected to the second device 200. The taper part 33 is provided between the body 30 and the first terminal part 31. The body 30 is a part that compresses the first sealing part 41 and the second sealing part 42 in the held state. The width W1 of the first terminal part 31 is narrower than the width W0 of the body 30. Thus, according to the connector 1 of the present embodiment, interference between the first terminal part 31 and the sealing part 40 when the conductor 3 is inserted into the hole 43 is suppressed. Furthermore, the taper part 33 allows the sealing part 40 to be gradually deformed.

Second Embodiment

Figure 22:
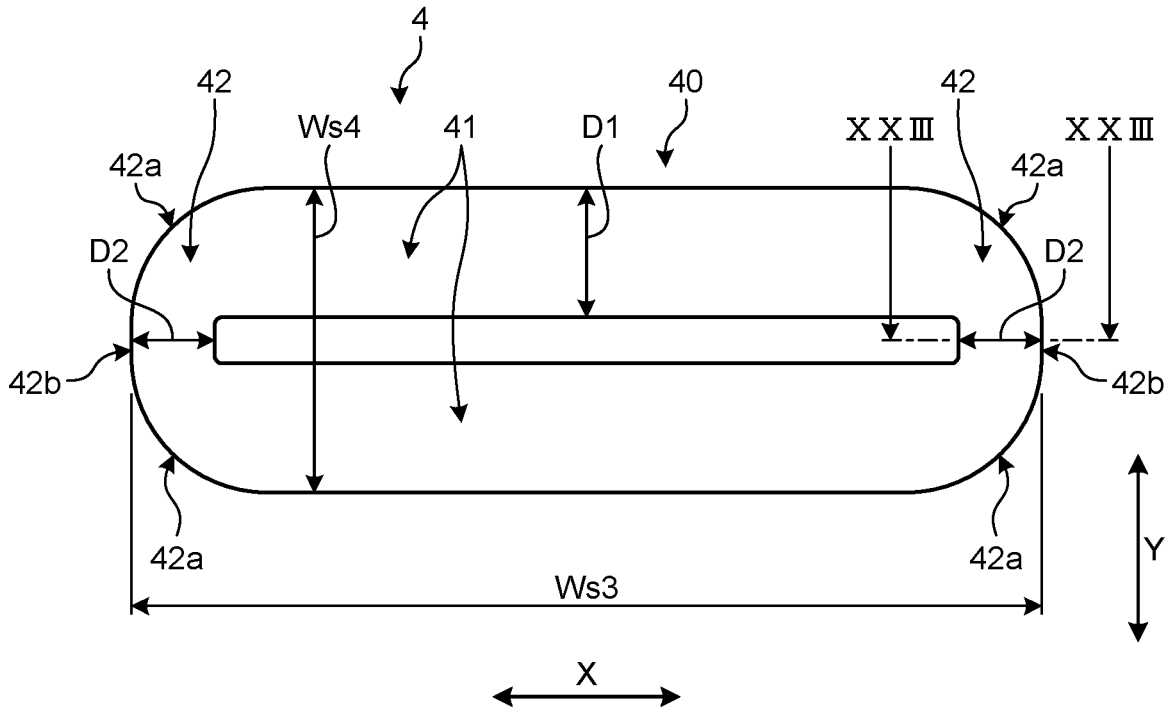
FIG. 22 is a plan view of a sealing member according to a second embodiment.
Figure 23:
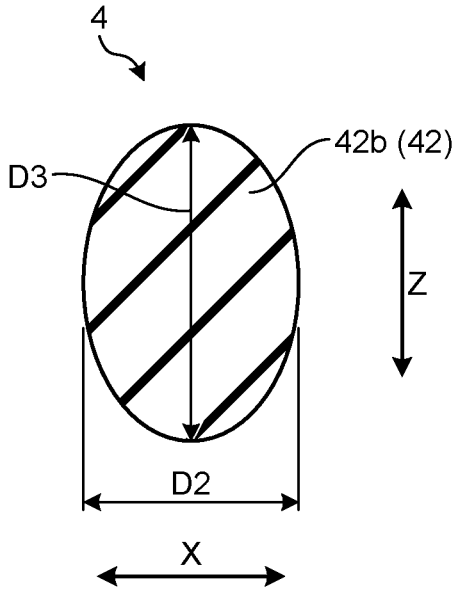
FIG. 23 is a sectional view of a second sealing part according to the second embodiment.

With reference to FIG. 22 and FIG. 23, the second embodiment will be described. In the second embodiment, components having the same functions as those described in the afore-mentioned first embodiment are denoted by the same reference numerals and redundant description thereof will be omitted. FIG. 22 is a plan view of a sealing member according to the second embodiment and FIG. 23 is a sectional view of a second sealing part according to the second embodiment. FIG. 23 illustrates a section taken along line XXIII-XXIII of FIG. 22. The sealing member 4 of the second embodiment is different from the sealing member 4 of the aforementioned first embodiment in the shape of the second sealing part 42, for example.

The second sealing part 42 of the second embodiment has two arc portions 42*a* and one linear portion 42*b*, similarly to the second sealing part 42 of the afore-mentioned first embodiment. In the sealing part 40 of the present embodiment, the thickness D2 of the second sealing part 42 is smaller than the thickness D1 of the first sealing part 41. As illustrated in FIG. 23, the second sealing part 42 of the present embodiment has a elliptical sectional shape. The long axis direction of the second sealing part 42 is the height direction Z and the short axis direction thereof is a direction orthogonal to the height direction Z. The short axis direction of the linear portion 42*b* is the first direction X.

The width D3 of the long axis direction of the second sealing part 42 is equal to the thickness D1 of the first sealing part 41. The thickness D2 of the linear portion 42*b* in a plan view is smaller than the thickness D1 of the first sealing part 41. The sectional shape of the second sealing part 42 is gradually changed such that the linear portion 42*b* has the smallest thickness. Specifically, the sectional shape of the arc portion 42*a* at the boundary with the first sealing part 41 is a circle that is the same as the sectional shape of the first sealing part 41. The sectional shape of the arc portion 42*a* at the boundary with the linear portion 42*b* is an elliptical shape that is the same as the sectional shape of the linear portion 42*b*.

Note that the sectional shape of the second sealing part 42 is not limited to the elliptical shape. For example, the sectional shape of the second sealing part 42 may be a circle having a diameter smaller than the thickness D1 of the first sealing part 41.

In the connector 1 of the present embodiment, by reducing the thickness D2 of the second sealing part 42, the outer dimension Ws3 of the sealing part 40 is made substantially equal to the inner dimension Wc1 of the third recess 24C. Since the outer dimension Ws3 is substantially equal to the inner dimension Wc1, when the sealing part 40 is received in the third recess 24C, bending deformation is less likely to occur in the first sealing part 41. Furthermore, the thickness D2 of the second sealing part 42 is small, so that the rigidity of the second sealing part 42 is smaller than that of the first sealing part 41. Thus, even though the compressive force F1 acts on the second sealing part 42, the second sealing part 42 is mainly deformed and the first sealing part 41 is less likely to be deformed.

In the connector 1 of the second embodiment, the conductor 3 compresses the sealing part 40, similarly to the connector 1 of the afore-mentioned first embodiment. The conductor 3 in the held state compresses the sealing part 40 such that the compression ratio Cp1 of the first sealing part 41 and the compression ratio Cp2 of the second sealing part 42 are substantially equal to each other, for example. In order to set the compression ratio Cp2 of the second sealing part 42 to a desired value, the width W0 of the body 30 of the conductor 3 may be adjusted, the inner dimension Wc1 of the third recess 24C may be adjusted, or the thickness D2 of the second sealing part 42 may be adjusted.

First Modification of Each Embodiment

Figure 24:
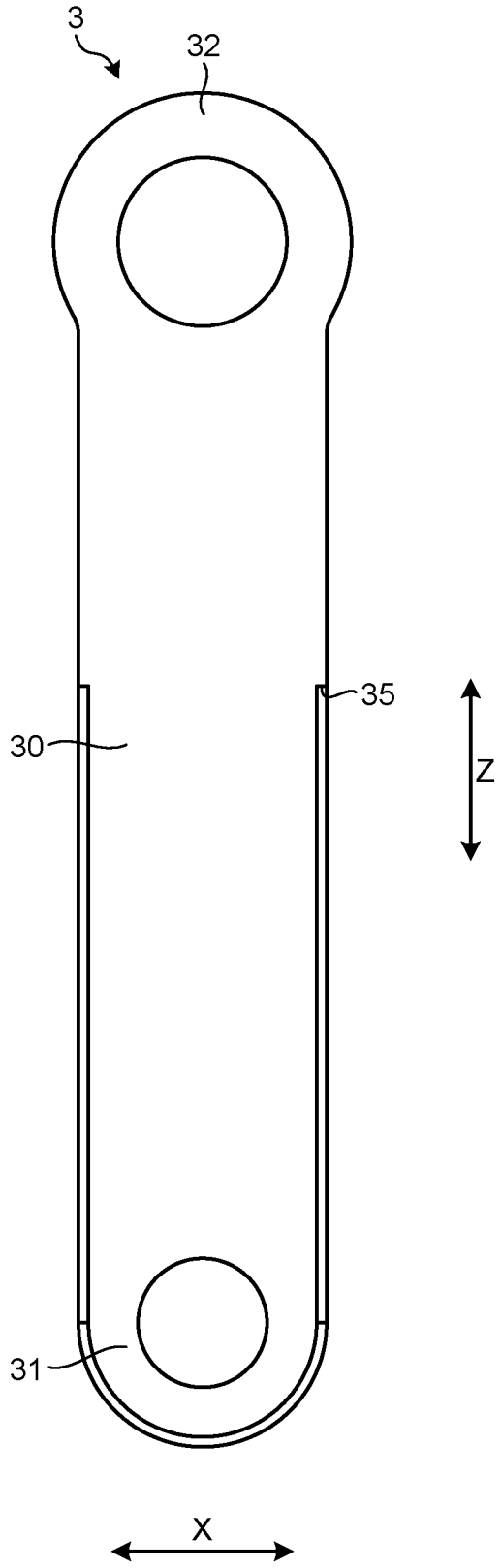
FIG. 24 is a front view of a conductor according to a first modification.

The first modification of the afore-mentioned first embodiment and second embodiment will be described. FIG. 24 is a front view of a conductor according to the first modification. The conductor 3 according to the first modification is different from the conductor 3 of the afore-mentioned each embodiment in that it does not have the taper part 33, for example. In the conductor 3 of the first modification, a width from the body 30 to the first terminal part 31 is constant. The body 30 is provided on the edge part thereof with a locking surface 35. When the conductor 3 is inserted into the second through-hole 54 of the support member 5, the locking surface 35 is locked by the second through-hole 54 and the conductor 3 is positioned.

Second Modification of Each Embodiment

Figure 25:
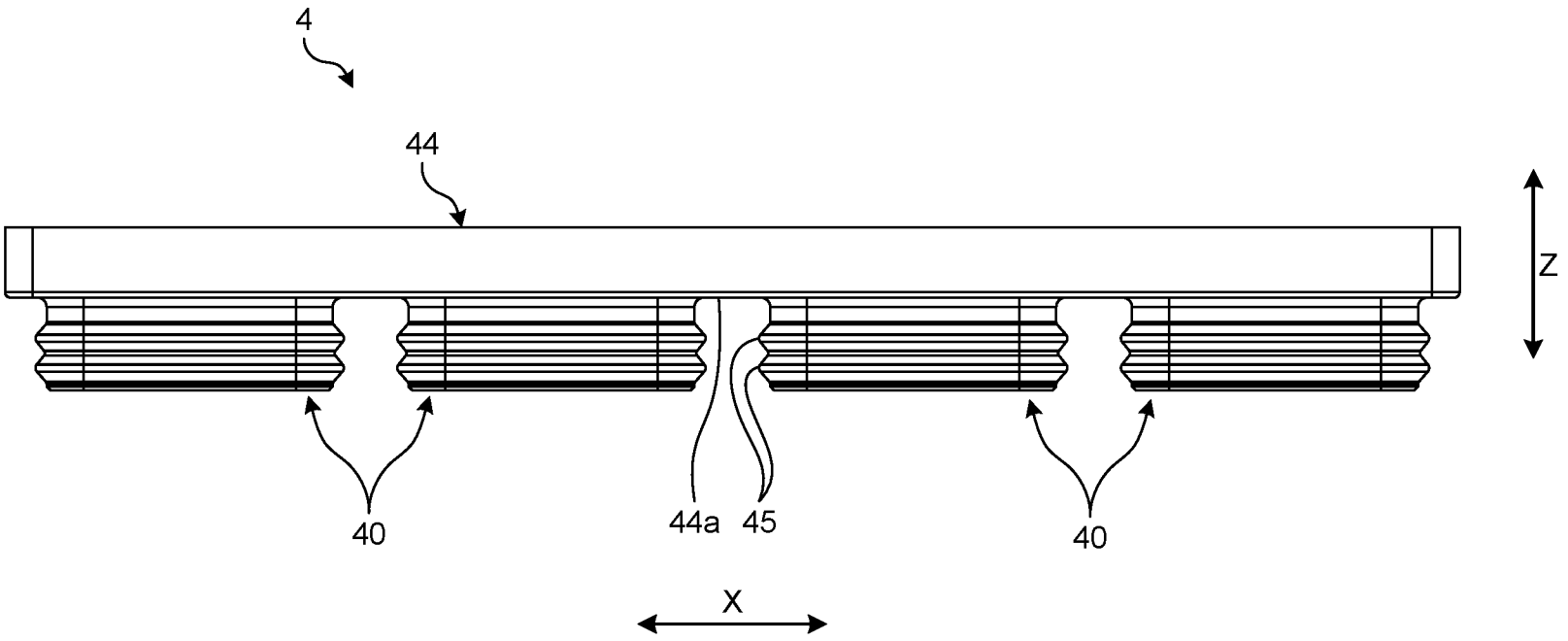
FIG. 25 is a front view of a sealing member according to a second modification.
Figure 26:
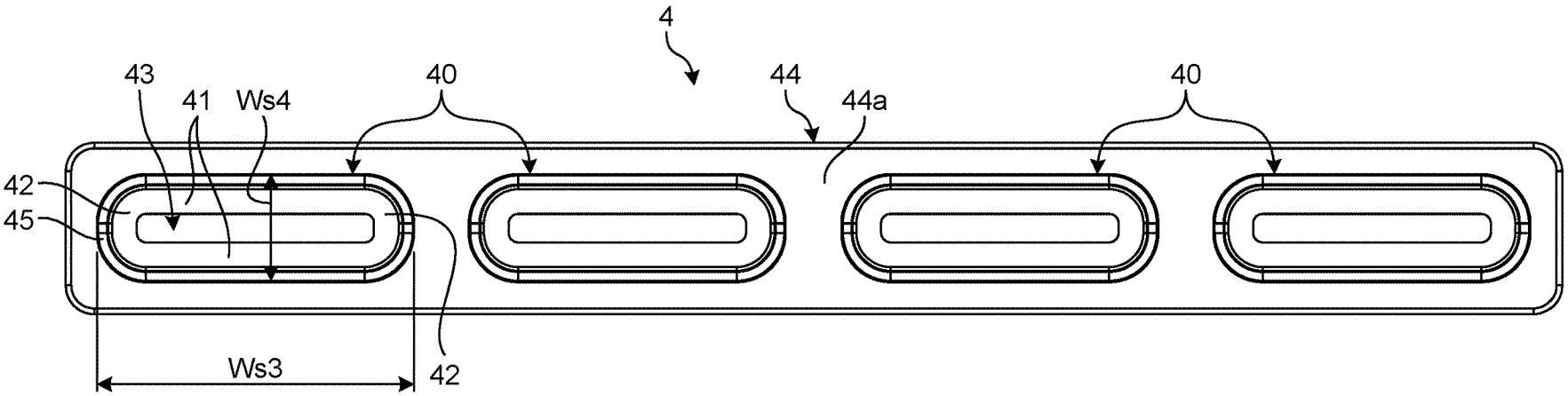
FIG. 26 is a bottom view of the sealing member according to the second modification.

The second modification of the afore-mentioned first embodiment and second embodiment will be described. FIG. 25 is a front view of a sealing member according to the second modification, and FIG. 26 is a bottom view of the sealing member according to the second modification. The second modification is different from the afore-mentioned each embodiment in that a plurality of sealing parts 40 are connected by a body 44. The sealing member 4 of the second modification has four sealing parts 40 and one body 44. The body 44 and the sealing parts 40 are integrally formed with each other. One end in an axial direction of the sealing part 40 is connected to a bottom surface 44*a* of the body 44.

As illustrated in FIG. 26, the planar shape of the sealing part 40 is a flat annular shape. The sealing part 40 has a pair of first sealing parts 41 and a pair of second sealing parts 42. The planar shape of the first sealing part 41 is a linear shape and the planar shape of the second sealing part 42 is an arc shape. The sealing part 40 of the second modification has a lip 45. The lip 45 is an annular protrusion provided on an outer peripheral surface of the sealing part 40. When the sealing part 40 is provided with the lip 45, the outer dimensions Ws3 and Ws4 of the sealing part 40 are, for example, dimensions including a tip end of the lip 45. The hole 43 penetrates the body 44.

The body 44 of the sealing member 4 is fitted into the second recess 24B of the housing 2. The support member 5 supports the body 44. According to the sealing member 4 of the second modification, the sealing parts 40 can be inserted into the third recesses 24C at one time.

Third Modification of Each Embodiment

The third modification of the embodiments will be described. The number of the sealing parts 40 included in the connector 1 is not limited to four illustrated in the embodiments. It is sufficient if the connector 1 has at least one sealing part 40. The shape of the sealing part 40 is not limited to the illustrated shape. For example, the second sealing part 42 may not have the linear portion 42*b*. In such a case, the planar shape of the second sealing part 42 may be semicircular.

A recess for receiving the sealing part 40 is not limited to the third recesses 24C illustrated in the embodiments. For example, the third recesses 24C of the afore-mentioned embodiments is a part of the recess 24 formed in multi-stages. However, the recess for receiving the sealing part 40 may be provided independently.

The contents disclosed in the afore-mentioned each embodiment and modifications can be combined and executed as appropriate.

In the connector according to the embodiment, the inner dimension in the longitudinal direction of the recess is substantially equal to the outer dimension in the longitudinal direction of the sealing part when the sealing part is not received in the recess. Furthermore, the conductor presses and compresses the first sealing part and the second sealing part toward the inner wall surfaces of the recess in the held state in which the conductor has been inserted into the first through-hole and held by the housing. In accordance with the connector according to the embodiment, it is possible to suppress bending deformation of the first sealing part when the sealing part is received in the recess. Thus, the connector of the present embodiment has an effect capable of suppressing the narrowing of the opening width of the annular sealing part.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an insulating housing configured to be fixed to a casing of a first device at a communication part through which an opening of the casing of the first device and an opening of a casing of a second device communicate with each other, and includes a first through-hole that allows an internal space of the first device and an internal space of the second device to communicate with each other;

a plate-shaped conductor configured to be inserted into the first through-hole to electrically connect the first device and the second device; and a sealing part that has a flat annular shape in a plan view and seals between the conductor and the housing, wherein the sealing part includes a pair of linear first sealing parts extending in a longitudinal direction and a pair of arc-shaped second sealing parts connecting end portions of the pair of first sealing parts, the housing includes a recess that has a flat shape in a plan view, is connected an end portion of the first through-hole, and receives the sealing part, an inner dimension in a longitudinal direction of the recess is substantially equal to an outer dimension in the longitudinal direction of the sealing part in a state in which the sealing part is not received in the recess, and an inner dimension in a short direction of the recess is smaller than an outer dimension in a short direction of the sealing part in the state in which the sealing part is not received in the recess, the conductor presses the first sealing part and the second sealing part toward inner wall surfaces of the recess and compresses the first sealing part and the second sealing part in a held state in which the conductor has been inserted into the first through-hole and held by the housing, and when the sealing part is viewed in a plan view, a thickness of the second sealing part is smaller than a thickness of the first sealing part.

2. The connector according to claim 1, wherein the conductor includes a body located at an intermediate part in a longitudinal direction of the conductor, a first terminal part located on one end side of the conductor with respect to the body and is connected to the first device, a second terminal part located on the other end side of the conductor with respect to the body and is connected to the second device, and a taper part provided between the body and the first terminal part, the body is a part that compresses the first sealing part and the second sealing part in the held state, and a width of the first terminal part is narrower than a width of the body.

3. The connector according to claim 1, wherein sizes of gaps between the conductor in the held state and the inner wall surfaces of the recess are sizes that allow a compression ratio of the first sealing part and a compression ratio of the second sealing part to be substantially equal to each other.

4. The connector according to claim 3, wherein the conductor includes a body located at an intermediate part in a longitudinal direction of the conductor, a first terminal part located on one end side of the conductor with respect to the body and is connected to the first device, a second terminal part located on the other end side of the conductor with respect to the body and is connected to the second device, and a taper part provided between the body and the first terminal part, the body is a part that compresses the first sealing part and the second sealing part in the held state, and a width of the first terminal part is narrower than a width of the body.

5. The connector according to claim 3, wherein the inner wall surface of the recess has a first wall surface facing the first sealing part in the short direction of the recess and a second wall surface facing the second sealing part in the longitudinal direction of the recess, and when the thickness of the first sealing part in the plan view is D1 and the thickness of the second sealing part is D2 in the plan view in the state in which the sealing part is not received in the recess, a size of a gap between the conductor in the held state and the first wall surface is Gp1, and a size of a gap between the conductor and the second wall surface is Gp2, an Equation (1) below is satisfied, $$Gp1/D1=Gp2/D2 \quad (1).$$

6. The connector according to claim 5, wherein the conductor includes a body located at an intermediate part in a longitudinal direction of the conductor, a first terminal part located on one end side of the conductor with respect to the body and is connected to the first device, a second terminal part located on the other end side of the conductor with respect to the body and is connected to the second device, and a taper part provided between the body and the first terminal part, the body is a part that compresses the first sealing part and the second sealing part in the held state, and a width of the first terminal part is narrower than a width of the body.

7. A connector comprising:

an insulating housing configured to be fixed to a casing of a first device at a communication part through which an opening of the casing of the first device and an opening of a casing of a second device communicate with each other, and includes a first through-hole that allows an internal space of the first device and an internal space of the second device to communicate with each other;

a plate-shaped conductor configured to be inserted into the first through-hole to electrically connect the first device and the second device; and a sealing part that has a flat annular shape in a plan view and seals between the conductor and the housing, wherein the sealing part includes a pair of linear first sealing parts extending in a longitudinal direction and a pair of arc-shaped second sealing parts connecting end portions of the pair of first sealing parts, the housing includes a recess that has a flat shape in a plan view, is connected an end portion of the first through-hole, and receives the sealing part, an inner dimension in a longitudinal direction of the recess is substantially equal to an outer dimension in the longitudinal direction of the sealing part in a state in which the sealing part is not received in the recess, and an inner dimension in a short direction of the recess is smaller than an outer dimension in a short direction of the sealing part in the state in which the sealing part is not received in the recess, the conductor presses the first sealing part and the second sealing part toward inner wall surfaces of the recess and compresses the first sealing part and the second sealing part in a held state in which the conductor has been inserted into the first through-hole and held by the housing, and sizes of gaps between the conductor in the held state and the inner wall surfaces of the recess are sizes that allow a compression ratio of the first sealing part and a compression ratio of the second sealing part to be substantially equal to each other.

* * * * *